US011247364B2

(12) United States Patent
Suzuki et al.

(10) Patent No.: US 11,247,364 B2
(45) Date of Patent: Feb. 15, 2022

(54) VENEER DEHYDRATION METHOD AND VENEER DEHYDRATION SYSTEM

(71) Applicant: Meinan Machinery Works, Inc., Obu (JP)

(72) Inventors: Shunichi Suzuki, Obu (JP); Yukio Hattori, Obu (JP)

(73) Assignee: MEINAN MACHINERY WORKS, INC., Obu (JP)

( * ) Notice: Subject to any disclaimer, the term of this patent is extended or adjusted under 35 U.S.C. 154(b) by 307 days.

(21) Appl. No.: 16/430,821

(22) Filed: Jun. 4, 2019

(65) Prior Publication Data

US 2020/0023543 A1 Jan. 23, 2020

(30) Foreign Application Priority Data

Jul. 20, 2018 (JP) ..... JP2018-137257

(51) Int. Cl.
*B27D 1/04* (2006.01)
*F26B 5/14* (2006.01)
*B27D 3/02* (2006.01)

(52) U.S. Cl.
CPC ..... *B27D 1/04* (2013.01); *B27D 3/02* (2013.01); *F26B 5/14* (2013.01); *F26B 2210/14* (2013.01)

(58) Field of Classification Search
CPC ..... B27D 1/04; B27D 3/02
See application file for complete search history.

(56) References Cited

U.S. PATENT DOCUMENTS 3,888,715 A * 6/1975 Fraser ..... C09J 5/06 156/274.6
5,662,760 A * 9/1997 Tsuda ..... B27D 1/00 100/38
6,007,659 A * 12/1999 Hasegawa ..... B27D 1/02 156/254
8,647,749 B2 * 2/2014 Norling ..... E04C 2/12 428/537.1
10,131,119 B2 * 11/2018 Freres ..... B32B 21/042
10,723,036 B2 * 7/2020 Okumura ..... B32B 21/13

FOREIGN PATENT DOCUMENTS

JP 4783862 B1 9/2011

* cited by examiner

*Primary Examiner* — Matthew Katcoff
(74) *Attorney, Agent, or Firm* — United IP Counselors, LLC

(57) ABSTRACT

A layered-up veneer board is formed by layering veneers up to a predetermined height such that the fiber directions of the respective veneers are alternately perpendicular to one another, and the layered-up veneer board is compressed by a compression device, to remove moisture contained in the veneers. Wood is a material in which the tensile strength in the fiber direction of the wood is higher than the tensile strength in the direction perpendicular to the fiber direction. With this layering scheme, even when stress is applied to the veneers and causes elongational deformation of these veneers as a result of compressing the layered-up veneer boards in the layering direction, elongational deformation of the veneers in the directions perpendicular to the fiber directions thereof can be reduced.

13 Claims, 24 Drawing Sheets

VENEER DEHYDRATION METHOD AND VENEER DEHYDRATION SYSTEM

CROSS-REFERENCE TO RELATED APPLICATIONS

This application claims priority to Japanese Patent Application No. 2018-137257, filed Jul. 20, 2018. The contents of that application are incorporated by reference herein in their entirety.

BACKGROUND

1. Field of the Invention

The invention relates to a veneer dehydration method and a veneer dehydration system for removing moisture contained in veneers.

2. Description of the Related Art

Japanese Patent Application No. 4783862 discloses a veneer dehydration method. In this veneer dehydration method, a layered-up veneer board, which is obtained by layering a plurality of veneers for plywood one above the other with the fiber directions thereof aligned, is loaded between a pair of upper and lower platens arranged facing each other, and then, of the side wall surfaces of the loaded layered-up veneer board, a pair of side wall surfaces extending along the fiber directions of the veneers is held by the restricting members which are installed on the lower platen so as to be able to protrude and retract. In this state, the upper and lower platens apply pressure to and compress the layered-up veneer board from above and below in the layering direction, to remove moisture contained in the layered-up veneer board.

According to this veneer dehydration method, when the upper and lower platens apply pressure to and compress the layered-up veneer board from above and below in the layering direction, the pair of restricting members restricts the plurality of veneers of the layered-up veneer board from stretching in the direction intersecting with the fiber directions ("fiber intersecting directions," hereinafter) of the veneers. Therefore, cracking of the veneers in the fiber directions thereof, which is attributed to such stretching, can be reduced.

BRIEF SUMMARY

However, the veneer dehydration method described above needs to operate the pair of restricting members along with a conveyor carrying the layered-up veneer board and the upper and lower platens, making the control complicated. Furthermore, a mechanism for operating the pair of restricting members is required in addition to the pair of restricting members, resulting in a complicated, enlarged device. If the plurality of veneers constituting the layered-up veneer board have non-uniform dimensions in the fiber intersecting directions, some of these veneers would not be restricted by the pair of restricting members from stretching in the fiber intersecting directions, resulting in cracks in such veneers in the fiber directions thereof. Even when the dimensions of the plurality of veneers are uniform in the fiber intersecting directions, as long as there exist veneers with lathe checks (cracking caused due to the difference in dimensions between the inner and outer peripheries of a veneer when a rotary lathe thinly cuts a log into a veneer and deforms the resultant veneer into a flat shape), the pair of restricting members cannot restrict such veneers from stretching in the fiber intersecting directions, resulting in cracks in the veneers in the fiber directions. In terms of preventing cracking of veneers without complicating the control and device or enlarging the device, there is still room for improvement.

The invention was contrived in view of the foregoing circumstances, and an object thereof is to provide a veneer dehydration method and a veneer dehydration system which, while simply constructed, are capable of not only restricting a veneer from stretching in the direction intersecting with the fiber direction of the veneer, but also reducing cracking of the veneer attributed to such stretching.

The veneer dehydration method and the veneer dehydration system according to the invention adopt the following measures in order to achieve the object described above.

According to a preferred aspect of the veneer dehydration method of the invention, a veneer dehydration method for removing moisture contained in veneers is constructed. The veneer dehydration method has the steps of (a) forming a layered-up veneer board by layering a second veneer, which is positioned with a fiber direction thereof aligned with a second direction intersecting with a first direction, on a first veneer positioned with a fiber direction thereof aligned with the first direction, and (b) removing moisture contained in the first and second veneers by applying pressure to and compressing the layered-up veneer board from above and below in a layering direction.

The concept of the term "fiber direction" used herein literally includes not only the fiber directions of wood seen on the primary surfaces of veneers, but also extension directions of lathe checks (cracking caused due to the difference in dimensions between the inner and outer peripheries of a veneer when a rotary lathe thinly cuts a log into a veneer and deforms the resultant veneer into a flat shape) formed in the veneers. The terms "first veneer" and "second veneer" used herein favorably encompass not only a single sheet of veneer but also a veneer that is obtained by bringing tightly or closely together a plurality of narrow veneers with unnecessary parts removed, and then joining these narrow veneers into a single sheet by using a joining material such as a joining tape, an adhesive, or staples, and a veneer that is obtained simply by bringing tightly or closely together a plurality of narrow veneers with unnecessary parts removed.

According to the invention, cracking attributed to stretching of the first and second veneers in the directions intersecting with the fiber directions of the first and second veneers can effectively be reduced by a very simple configuration of using the anisotropy of the strengths of the veneers. Specifically, the tensile strength of a veneer in the same direction as the fiber direction of the veneer is higher than the tensile strength in the direction intersecting with said fiber direction, and therefore the veneer is more likely to stretch and become deformed in the direction intersecting with the fiber direction than in the same direction as the fiber direction. In view of this property inherent in veneers, when compressing the layered-up veneer board, the configuration in which the first and second veneers are layered with the fiber directions thereof intersecting with each other can favorably reduce stretching of the first veneer in the direction intersecting with the fiber direction thereof, due to the relatively high tensile strength in the fiber direction of the second veneer in frictional contact (static friction) with the first veneer. Furthermore, the configuration in which the first and second veneers are layered with the fiber directions thereof intersecting with each other can favorably reduce stretching of the second veneer in the direction intersecting with the fiber direction thereof, due to the relatively high tensile strength in the fiber direction of the first veneer in frictional contact (static friction) with the second veneer. The invention, therefore, can effectively reduce cracking of the first and second veneers which could be caused as a result of the first and second veneers stretching in the directions intersecting with the fiber directions thereof.

The first and second veneers may each include a square veneer which has a square shape when viewed from one side in a direction along the layering direction. The first and second veneers may also each include a rectangular veneer which has a rectangular shape when viewed from one side in a direction along the layering direction. The rectangular veneer may be formed to have a long side approximately twice as long as a short side.

According to another aspect of the veneer dehydration method of the invention, the step (a) forms the layered-up veneer board by alternately layering the first veneer and the second veneer.

According to this aspect, the effect of reducing stretching of the first and second veneers in the directions intersecting with the fiber directions thereof can be achieved on both front and rear surfaces of all of the first and second veneers constituting the layered-up veneer board, due to the relatively high tensile strengths in the fiber directions of the first and second veneers in frictional contact (static friction) with each other by the front and rear surfaces thereof. Thus, cracking attributed to stretching of the first and second veneers in the directions intersecting with the fiber directions thereof can be reduced more effectively. In regard to the first or second veneer disposed at the bottom and top of the layered-up veneer board in the layering direction, either the front or rear surface is restrained by a pair of platens for compressing the layered-up veneer board, preventing the first or second veneer from stretching in the direction intersecting with the fiber direction thereof.

According to yet another aspect of the veneer dehydration method of the invention, the step (a) forms a layered body by layering a pair of the second veneers on the first veneer, and forms the layered-up veneer board by layering a plurality of the layered bodies.

According to this aspect, in the relationship between the first and second veneers, stretching of the first veneer in the direction intersecting with the fiber direction thereof can be reduced by the relatively high tensile strength in the fiber direction of the pair of second veneers in frictional contact (static friction) with the first veneer, and stretching of the pair of second veneers in the direction intersecting with the fiber direction thereof can be reduced by the relatively high tensile strength in the fiber direction of the first veneer in frictional contact (static friction) with the pair of second veneers. Thus, cracking attributed to stretching of the first and second veneers in the directions intersecting with the fiber directions of the first and second veneers can be reduced. In regard to the first or second veneer disposed at the bottom and top of the layered-up veneer board in the layering direction, either the front or rear surface is restrained by a pair of platens for compressing the layered-up veneer board, preventing the first or second veneer from stretching in the direction intersecting with the fiber direction thereof.

According to yet another aspect of the veneer dehydration method of the invention, the step (a) forms a layered body by layering a pair of the second veneers on a pair of the first veneers, and forms the layered-up veneer board by layering a plurality of the layered bodies.

According to this aspect, in the relationship between the first and second veneers, the fiber directions of the pair of first veneers and the pair of second veneers intersect with each other. Thus, stretching of the first veneers in the direction intersecting with the fiber direction thereof can be reduced by the relatively high tensile strength in the fiber direction of the pair of second veneers in frictional contact (static friction) with the pair of first veneers, and stretching of the second veneers in the direction intersecting with the fiber direction thereof can be reduced by the relatively high tensile strength in the fiber direction of the pair of first veneers in frictional contact (static friction) with the pair of second veneers. Thus, cracking attributed to stretching of the first and second veneers in the directions intersecting with the fiber directions of the first and second veneers can be reduced. In regard to the first or second veneer disposed at the bottom and top of the layered-up veneer board in the layering direction, either the front or rear surface is restrained by a pair of platens for compressing the layered-up veneer board, preventing the first or second veneer from stretching in the direction intersecting with the fiber direction thereof.

According to yet another aspect of the veneer dehydration method of the invention, the step (a) forms a layered body by layering a set of three of the second veneers on the first veneer, and forms the layered-up veneer board by layering a plurality of the layered bodies.

According to this aspect, in the relationship between the first and second veneers, stretching of the first veneer in the direction intersecting with the fiber direction thereof can be reduced by the relatively high tensile strength in the fiber direction of the pair of second veneers in frictional contact (static friction) with the first veneer, and stretching of the pair of second veneers in the direction intersecting with the fiber direction thereof can be reduced by the relatively high tensile strength in the fiber direction of the first veneer in frictional contact (static friction) with the pair of second veneers. Between the second veneers, i.e., between two second veneers adjacent respectively to the first veneers closest thereto and the second veneer sandwiched between said two second veneers, the effect of reducing stretching of said two second veneers adjacent to the first veneers, in the direction intersecting with the fiber directions of said two second veneers, also acts on the second veneer sandwiched between said two second veneers. Therefore, stretching of the second veneer sandwiched between said two second veneers in the direction intersecting with the fiber direction thereof can be reduced. Thus, cracking attributed to stretching of the first and second veneers in the directions intersecting with the fiber directions of the first and second veneers can be reduced. In regard to the first or second veneer disposed at the bottom and top of the layered-up veneer board in the layering direction, either the front or rear surface is restrained by a pair of platens for compressing the layered-up veneer board, preventing the first or second veneer from stretching in the direction intersecting with the fiber direction thereof.

According to yet another aspect of the veneer dehydration method of the invention, the step (a) forms a layered body by layering a set of three of the second veneers on a pair of the first veneers, and forms the layered-up veneer board by layering a plurality of the layered bodies.

According to this aspect, in the relationship between the first and second veneers, stretching of the first veneer in the direction intersecting with the fiber direction thereof can be reduced by the relatively high tensile strength in the fiber direction of the pair of second veneers in frictional contact (static friction) with the first veneer, and stretching of the pair of second veneers in the direction intersecting with the fiber direction thereof can be reduced by the relatively high tensile strength in the fiber direction of the first veneer in frictional contact (static friction) with the pair of second veneers. Between the second veneers, i.e., between two second veneers adjacent respectively to the first veneers closest thereto and the second veneer sandwiched between said two second veneers, the effect of reducing stretching of said two second veneers adjacent to the first veneers, in the direction intersecting with the fiber directions of said two second veneers, also acts on the second veneer sandwiched between said two second veneers. Therefore, stretching of the second veneer sandwiched between said two second veneers in the direction intersecting with the fiber direction thereof can be reduced. Thus, cracking attributed to stretching of the first and second veneers in the directions intersecting with the fiber directions of the first and second veneers can be reduced. In regard to the first or second veneer disposed at the bottom and top of the layered-up veneer board in the layering direction, either the front or rear surface is restrained by a pair of platens for compressing the layered-up veneer board, preventing the first or second veneer from stretching in the direction intersecting with the fiber direction thereof.

According to yet another aspect of the veneer dehydration method of the invention, the step (a) forms a layered body by layering a set of three of the second veneers on a set of three of the first veneers, and forms the layered-up veneer board by layering a plurality of the layered bodies.

According to this aspect, in the relationship between the first and second veneers, stretching of the first veneer in the direction intersecting with the fiber direction thereof can be reduced by the relatively high tensile strength in the fiber direction of the pair of second veneers in frictional contact (static friction) with the first veneer, and stretching of the pair of second veneers in the direction intersecting with the fiber direction thereof can be reduced by the relatively high tensile strength in the fiber direction of the first veneer in frictional contact (static friction) with the pair of second veneers. Between the first veneers, i.e., between two first veneers adjacent respectively to the second veneers closest thereto and the first veneer sandwiched between said two first veneers, the effect of reducing stretching of said two first veneers adjacent to the second veneers, in the direction intersecting with the fiber directions of said two first veneers, also acts on the first veneer sandwiched between said two first veneers. Therefore, stretching of the first veneer sandwiched between said two first veneers in the direction intersecting with the fiber direction thereof can be reduced. Between the second veneers, i.e., between two second veneers adjacent respectively to the first veneers closest thereto and the second veneer sandwiched between said two second veneers, the effect of reducing stretching of said two second veneers adjacent to the first veneers, in the direction intersecting with the fiber directions of said two second veneers, also acts on the second veneer sandwiched between said two second veneers. Therefore, stretching of the second veneer sandwiched between said two second veneers in the direction intersecting with the fiber direction thereof can be reduced. Thus, cracking attributed to stretching of the first and second veneers in the directions intersecting with the fiber directions of the first and second veneers can be reduced. In regard to the first or second veneer disposed at the bottom and top of the layered-up veneer board in the layering direction, either the front or rear surface is restrained by a pair of platens for compressing the layered-up veneer board, preventing the first or second veneer from stretching in the direction intersecting with the fiber direction thereof.

According to yet another aspect of the veneer dehydration method of the invention, the step (a) includes reversing the first veneer to position the second veneer such that the fiber direction thereof extends along the second direction.

According to this aspect, by simply reversing the first veneer, the second veneer can be positioned such that the fiber direction thereof intersects with the fiber direction of the first veneer.

According to a preferred aspect of the dehydration system of the invention, a veneer dehydration system for removing moisture contained in veneers is constructed. The veneer dehydration system includes a veneer stacking device capable of stacking veneers, layered, a first conveying device for conveying the veneers to the veneer stacking device with a fiber direction of the veneers aligned with a first direction, a second conveying device for conveying the veneers to the veneer stacking device with the fiber direction of the veneers aligned with a second direction intersecting with the first direction, a veneer compression device having first and second platens disposed on either side of a layering direction of the veneers, and a loading device for loading, between the first and second platens, a layered-up veneer board stacked on the veneer stacking device.

According to the invention, cracking attributed to stretching of the first and second veneers in the directions intersecting with the fiber directions of the first and second veneers can effectively be reduced by a very simple configuration of using the anisotropy of the strengths of the veneers. Specifically, the tensile strength of a veneer in the same direction as the fiber direction of the veneer is higher than the tensile strength in the direction intersecting with the fiber direction of the veneer, and therefore the veneer is more likely to stretch and become deformed in the direction intersecting with the fiber direction than in the same direction as the fiber direction. In view of this property inherent in veneers, when compressing the layered-up veneer board having the first and second veneers layered with the fiber directions thereof intersecting with each other, stretching of the first veneer in the direction intersecting with the fiber direction thereof can favorably be reduced by the relatively high tensile strength in the fiber direction of the second veneer in frictional contact (static friction) with the first veneer. Furthermore, stretching of the second veneer in the direction intersecting with the fiber direction thereof can favorably be reduced by the relatively high tensile strength in the fiber direction of the first veneer in frictional contact (static friction) with the second veneer. The invention, therefore, can effectively reduce cracking of the first and second veneers which could be caused as a result of the first and second veneers stretching in the directions intersecting with the fiber directions thereof.

The invention, while simply constructed, is capable of not only restricting a veneer from stretching in a direction intersecting with a fiber direction of the veneer or in a direction in which lathe checks of the veneer expand, but also reducing cracking of the veneer attributed to such stretching.

DETAILED DESCRIPTION

The best modes for carrying out the invention are now described hereinafter with reference to examples.

Example 1

Figure 1:
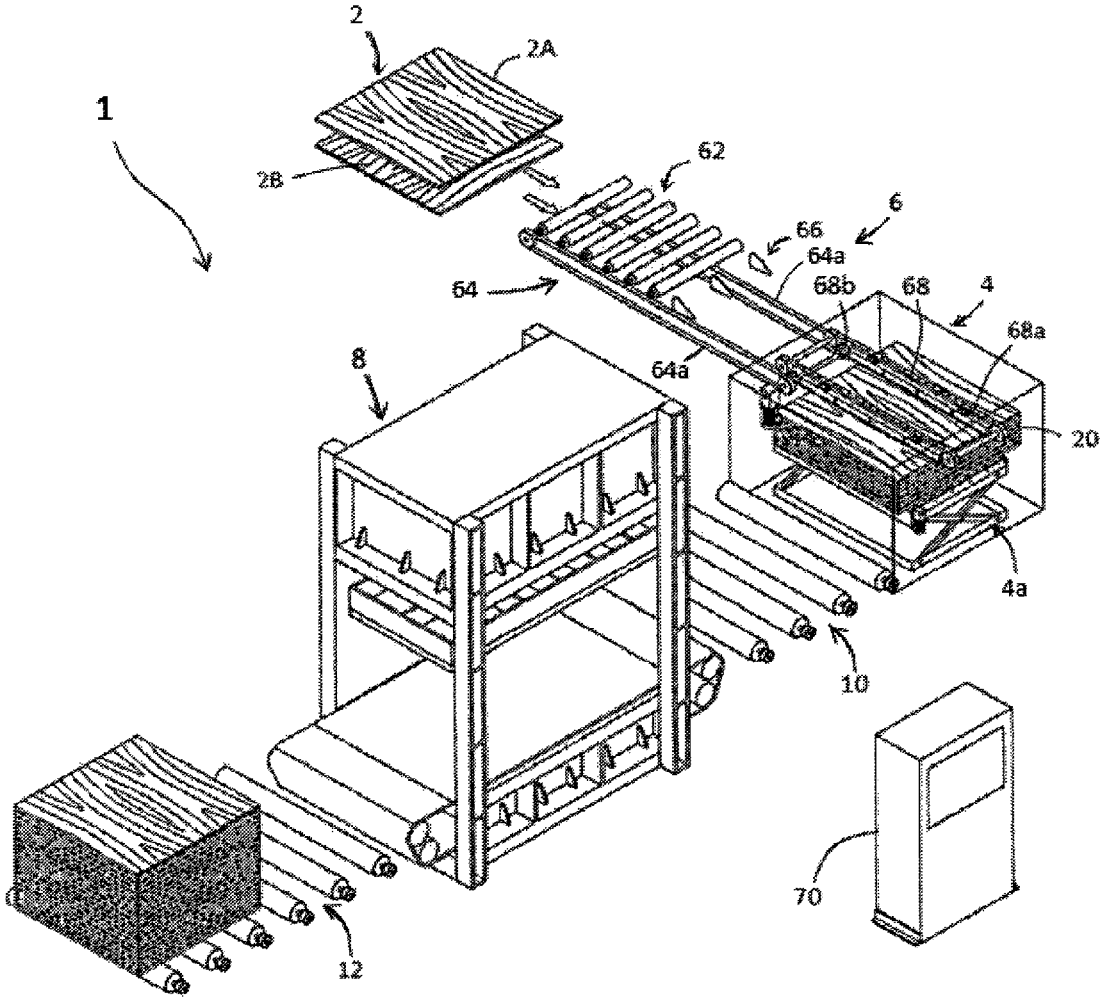
FIG. 1 is a schematic configuration diagram showing an outline of a configuration of a veneer dehydration system 1 according to an embodiment of the invention.

As shown in FIG. 1, a veneer dehydration system 1 according to an embodiment of the invention includes a veneer stacking device 4 capable of stacking veneers 2 into layers, a conveying device 6 for conveying veneers 2 to the veneer stacking device 4, a compression device 8 for compressing the layered veneers 2 ("layered-up veneer board 20," hereinafter) in a layering direction, a loading device 10 for loading the layered-up veneer board 20 of the veneer stacking device 4 onto the compression device 8, an unloading device 12 for unloading the layered-up veneer board 20 from the compression device 8, and a controller 70 for controlling the entire system.

Figure 2:
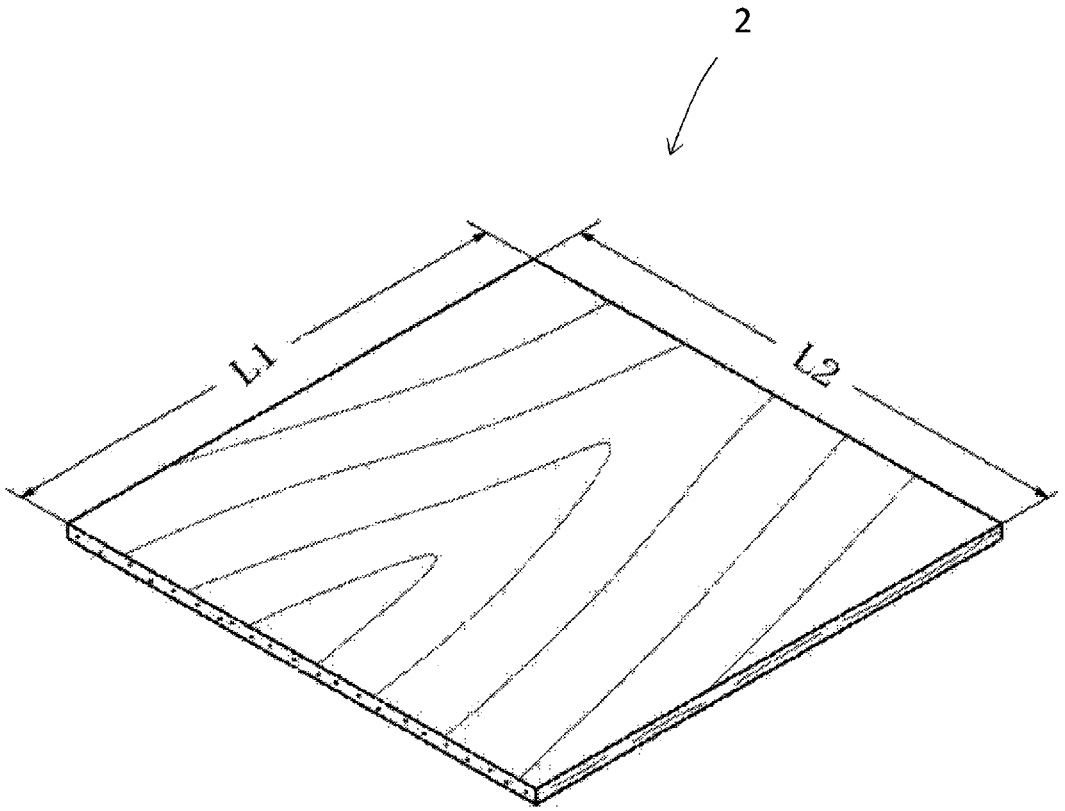
FIG. 2 is a perspective view showing the exterior of a veneer 2.
Figure 3:
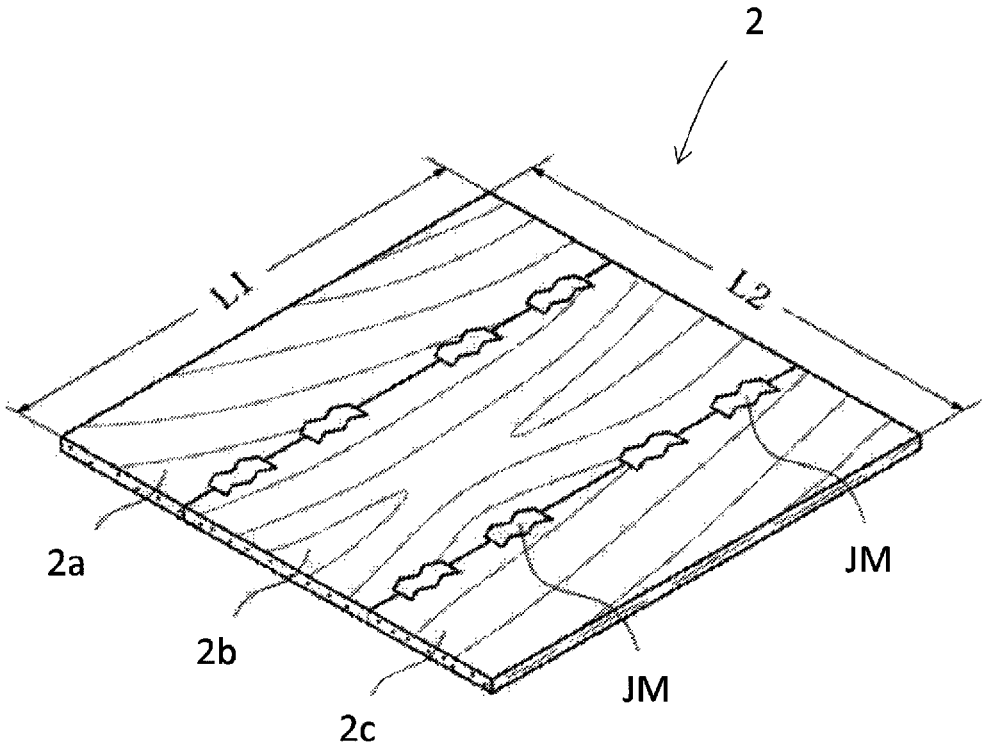
FIG. 3 is a perspective view showing the exterior of a veneer 2 formed by bringing narrow veneers 2*a*, 2*b* and 2*c* together and joining the veneers 2*a*, 2*b* and 2*c* using a joining material.
Figure 4:
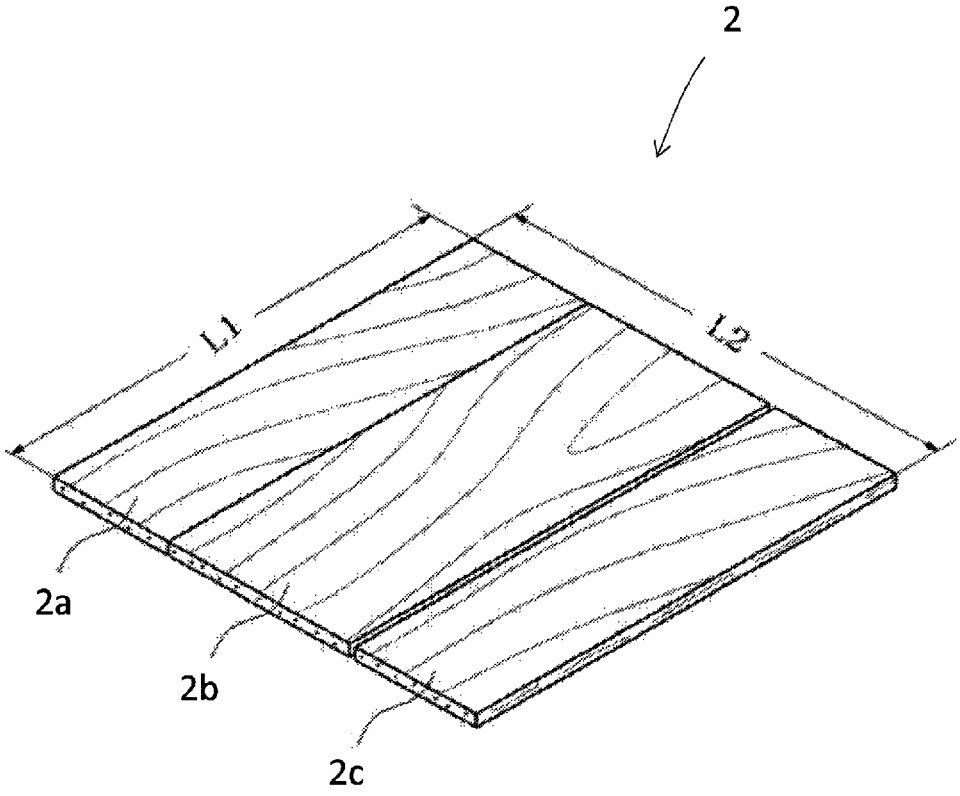
FIG. 4 is a perspective view showing the exterior of a veneer 2 formed by bringing the narrow veneers 2*a*, 2*b* and 2*c* together.

A veneer 2 is obtained by thinly cutting a log using a veneer lathe, not shown. In this embodiment, as shown in FIGS. 2 to 4, the veneer 2 is in a square shape when viewed from the direction perpendicular to a primary surface of the veneer 2 (the length of the veneer 2 along a fiber direction thereof is roughly equal to the length of the veneer 2 along the direction perpendicular to the fiber direction). Note that, in this embodiment, the veneer 2 is cut out so that the fiber direction thereof is roughly parallel to one of the two pairs of sides defining the outer periphery of the veneer 2.

Also, the concept of the veneer 2 includes not only a standard-size veneer 2 that is obtained by cutting a continuous, strip-like veneer with no unnecessary parts into a predetermined standard length as shown in FIG. 2, but also a standard-size veneer 2 that is obtained by bringing rectangular, narrow veneers 2*a*, 2*b* and 2*c* tightly or very closely together, the narrow veneers having most or all of unnecessary parts removed, and then cutting the veneers 2*a*, 2*b* and 2*c* into a predetermined standard length, as shown in FIGS. 3 and 4. The narrow veneers 2*a*, 2*b* and 2*c* that are brought tightly or very closely together are preferably joined using a joining material JM such as a joining tape, an adhesive, of staples, as shown in FIG. 3.

Note that, in order to form such a square veneer 2 by dividing a rectangular veneer of universal dimensions into two, a conventional method for manufacturing a laminated material, namely a method for manufacturing a laminated veneer material, can be directly used in which a product (a plywood board, a laminated veneer material, etc.) is manufactured by piling multiple veneers 2 in a staircase pattern with the fiber directions thereof aligned every desired number of veneers, and then gluing them together. Alternatively, after dehydration, two sheets of square veneers 2 can be connected along the same direction as the fiber direction of these veneers 2 or along the direction perpendicular to the fiber direction, to once again form a rectangular veneer of universal dimensions, and the abovementioned conventional method for manufacturing a laminated material can be directly used to manufacture a product (a plywood board, a laminated veneer material, etc.).

The term "the same direction as the fiber direction" favorably includes literally the direction same as the fiber direction, as well as the direction roughly extending along the fiber direction. The term "the direction perpendicular to the fiber direction" favorably includes literally the direction orthogonal to the fiber direction, as well as the direction roughly orthogonal to the fiber direction.

Figure 5:
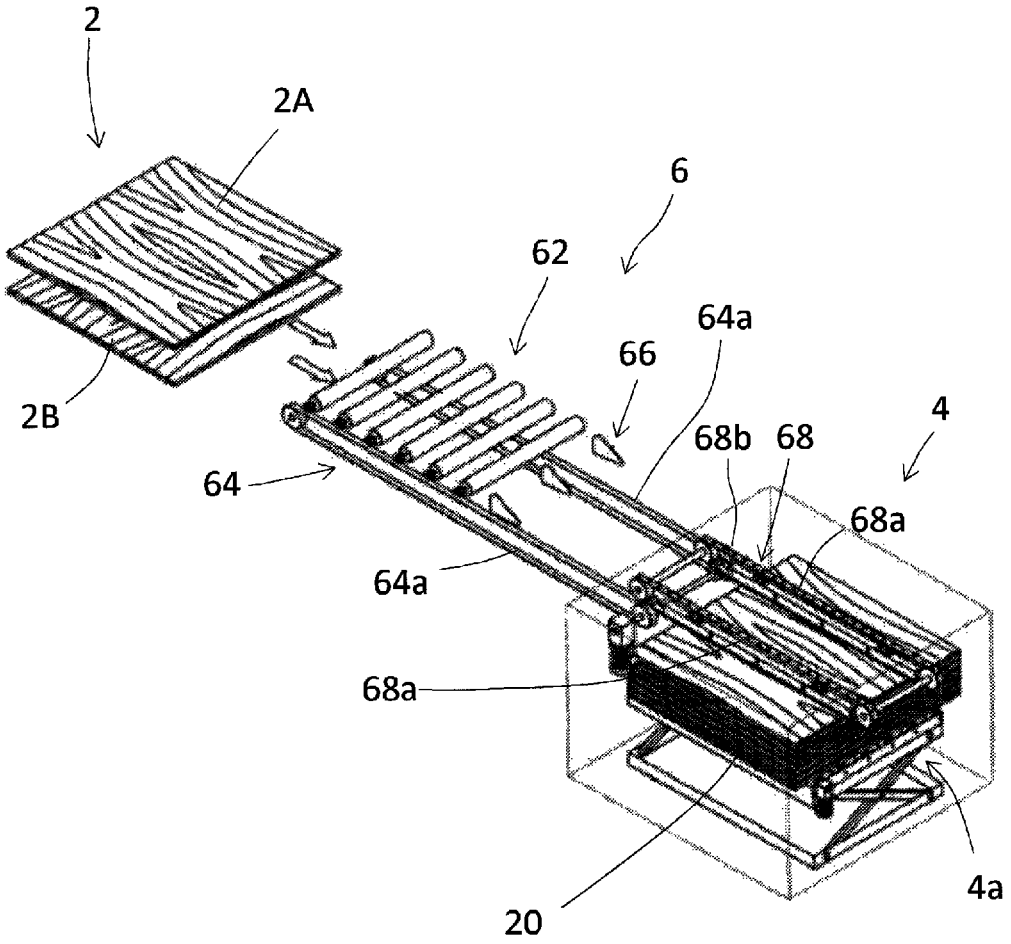
FIG. 5 is a perspective view showing an outline of a configuration of a conveying device 6.

As shown in FIG. 5, the veneer stacking device 4 has a stacking portion 4*a* configured to be able to move up and down. The veneers 2 are piled up on the stacking portion 4*a* until the height of the piled veneers 2 reaches a predetermined value. Once the height of the piled veneers 2 is the predetermined value, the resultant layered-up veneer board 20 is carried to the loading device 10. Note that the height of the layered-up veneer board 20 is desirably approximately 1 m to 2 m (preferably approximately 1.3 m to 1.7 m) in view of the resiliency of the layered-up veneer board 20 after compression thereof by the compression device 8 is finished, and the stability of conveying the layered-up veneer board 20 by the conveying device 6, the loading device 10 (see FIG. 1), and the unloading device 12 (see FIG. 1).

As shown in FIG. 5, the conveying device 6 has an upper conveying line 62, a lower conveying line 64 disposed immediately below the upper conveying line 62, an inclined conveying portion 66, and a needle belt conveyor 68. The upper conveying line 62 is configured as a roller conveyor and is shorter than the lower conveying line 64 in a conveyance direction. The lower conveying line 64 is configured as a belt conveyor having a pair of belts 64*a* and 64*a* and has a length reaching the veneer stacking device 4. Note that the veneers 2 having their fiber directions rotated 90 degrees to one another are loaded onto the upper conveying line 62 and the lower conveying line 64.

As shown in FIG. 5, the inclined conveying portion 66 is disposed at the end of the upper conveying line 62. The inclined conveying portion 66 has an inclined surface tilting downward from the upper conveying line 62 toward the pair of belts 64*a* and 64*a* of the lower conveying line 64, and functions to transfer, to the lower conveying line 64, the veneers 2 conveyed by the upper conveying line 62.

The needle belt conveyor 68 has a pair of belts 68*a* and 68*a* having belt-shaped needles and a veneer dropping device 68*b*, and is configured to traverse the veneer stacking device 4 vertically from a position immediately above the end of the lower conveying line 64. It is preferred that the needles of the needle belt conveyor 68 each have a length equivalent to the thickness of two or more sheets of veneers 2.

Figure 6:
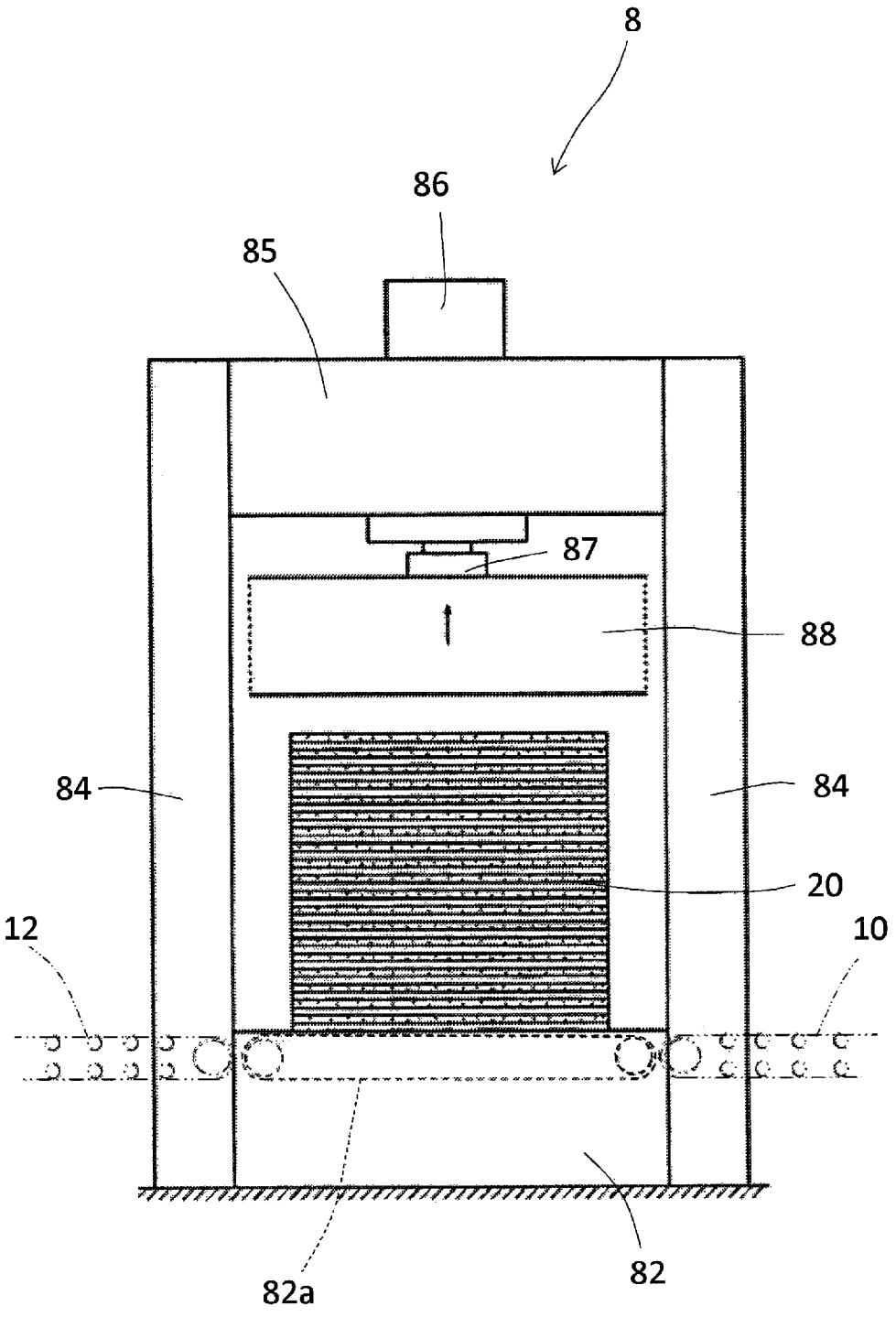
FIG. 6 is a schematic configuration diagram showing an outline of a configuration of a compression device 8.

As shown in FIG. 6, the compression device 8 includes a lower platen 82 serving as a base, a vertical machine frame 84 installed on the side of the lower platen 82, a horizontal machine frame 85 bridging over an upper end of the vertical machine frame 84, an activation mechanism 86 mounted on the horizontal machine frame 85, and an upper platen 88 mounted on the activation mechanism 86 via a coupling member 87. The compression device 8 is an example of an implementation configuration corresponding to the "veneer compression device" of the invention. The lower platen 82 is an example of an implementation configuration corresponding to the "first platen" of the invention, and the upper platen 88 is an example of an implementation configuration corresponding to the "second platen" of the invention.

The lower platen 82 and the upper platen 88 are each formed to have an area substantially equal to or slightly larger than the area of each veneer 2. As shown in FIG. 6, an in-platen conveyor 82*a* is embedded in the lower platen 82. The in-platen conveyor 82*a* is configured to be movable by a lifting device, not shown, between a conveyance position slightly protruding from an upper surface of the lower platen 82 and a retraction position lower than the upper surface of the lower platen 82. Note that the in-platen conveyor 82*a* may be configured to be movable between the conveyance position and the retraction position by means of the elastic force of an elastic body instead of using the lifting device. In such a case, a plurality of lines of grooves can be provided at appropriate intervals in the lower platen 82, and the in-platen conveyor 82*a* biased by the elastic body can be positioned in these grooves.

A hydraulic cylinder, for example, can be used as the activation mechanism 86. In this case, the upper platen 88 is attached to a tip of a cylinder rod of the hydraulic cylinder via the coupling member 87. Needless to say, the activation mechanism 86 can be configured to use a screw mechanism, a cam mechanism, or the like. Alternatively, a plurality of the activation mechanisms 86 can be provided. In such a case, the activation mechanisms 86 can be controlled individually. Accordingly, when moving the upper platen 88 up and down, the upper platen 88 can favorably be prevented from being moved up and down while tilted.

The controller 70 is configured as a microprocessor such as a CPU, and includes, in addition to the CPU, a ROM for storing processing programs, a RAM for temporarily storing data, input and output ports, and a communication port. A signal and the like from a sensor (not shown) for detecting the height of the piled veneers 2 are input to the controller 70 via the input port. The controller 70 outputs drive signals to the conveying device 6, the veneer stacking device 4, the compression device 8, the loading device 10, and the unloading device 12 via the output port.

Operations of the veneer dehydration system 1 configured as above are described next. First, the controller 70 drives the conveying device 6 and the needle belt conveyor 68 and, as shown in FIG. 1, conveys to the veneer stacking device 4 veneers 2A and 2B that are fed simultaneously and respectively to the upper conveying line 62 and the lower conveying line 64, with the fiber directions of the veneers 2A and 2B rotated 90 degrees to each other.

The veneer 2A conveyed by the upper conveying line 62 is transferred to the lower conveying line 64 by the inclined conveying portion 66 disposed at the end of the upper conveying line 62. In so doing, the veneer 2A is superposed on the veneer 2B conveyed by the lower conveying line 64, thereby constructing a layered body 2' having the two veneers 2A and 2B stacked together, with the fiber directions thereof arranged perpendicular to each other (see FIG. 8).

Figure 8:
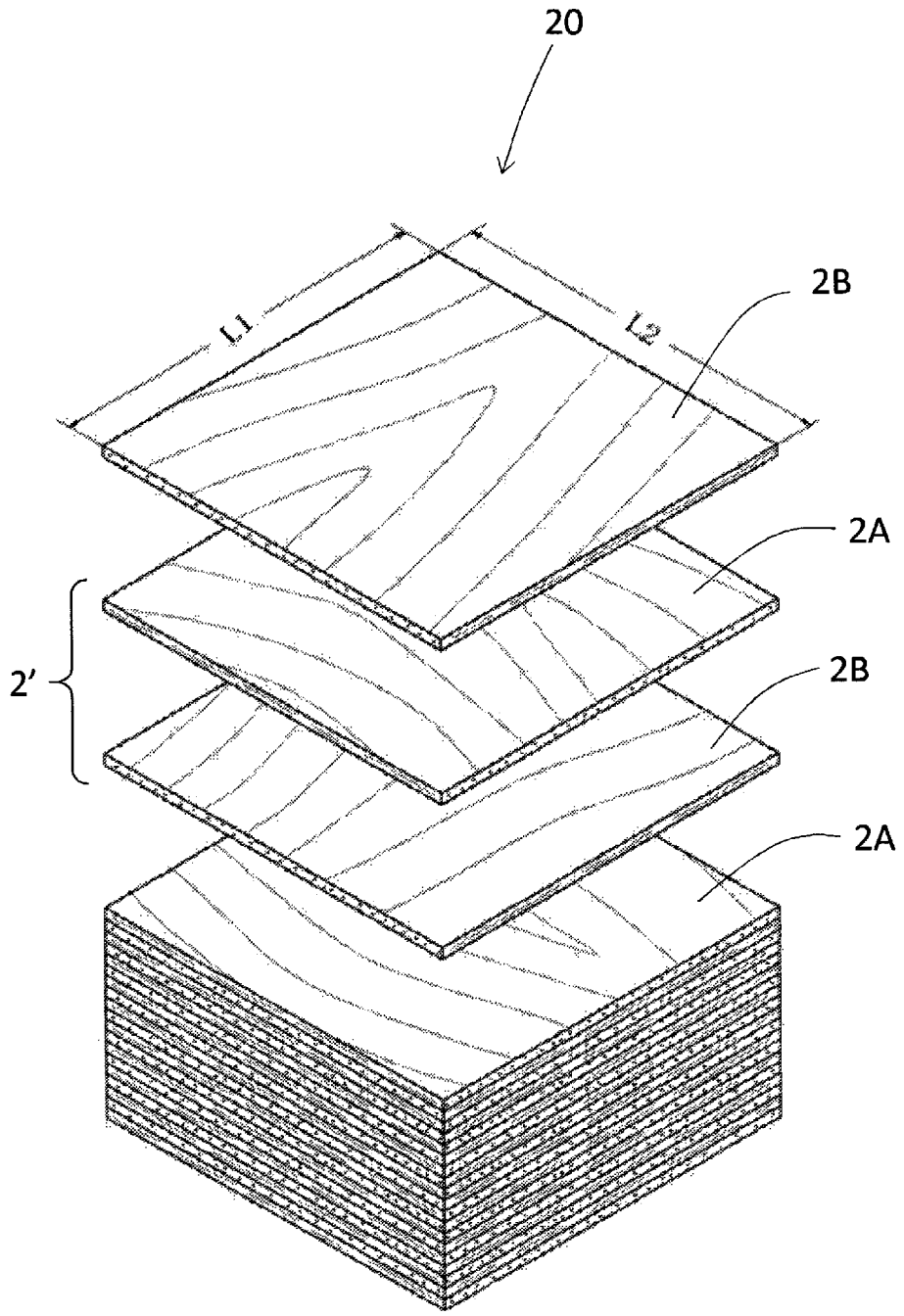
FIG. 8 is an exploded perspective view showing a part of the layered-up veneer board 20.

The layered body 2' (see FIG. 8) is conveyed to the needle belt conveyor 68 by the lower conveying line 64. After being conveyed to the needle belt conveyor 68, the layered body 2' (see FIG. 8) is then stuck to the needles of the needle belt conveyor 68, conveyed to the position immediately above the stacking portion 4*a* of the veneer stacking device 4, pulled away from the needle belt conveyor 68 by the veneer dropping device 68*b*, and stacked on the stacking portion 4*a*. This operation is repeated by the controller 70 until the height of the piled veneers 2 reaches the predetermined value as shown in FIG. 8. This operation eventually forms the layered-up veneer board 20 in which the veneers 2 are layered to the predetermined height such that the fiber directions of the respective veneers 2 are perpendicular to one another.

When layering the veneers 2A and 2B, a floor plate (portable platen), not shown, is laid on the stacking portion 4*a* in advance, and then the veneers 2A and 2B are stacked on this floor plate (portable platen), thereby realizing stable positions of the veneers 2A and 2B when layering the veneers 2A and 2B and easy shifting of the layered-up veneer board 20 to the subsequent step. Note that an intermediate floor plate, not shown, may be placed every appropriate number of veneers 2A and 2B. From the perspective of the effectiveness of dehydration, the sizes of the floor plate (portable platen) and the intermediate floor plate are desirably large enough to cover at least the veneers 2A and 2B (even if the veneers 2A and 2B are stacked somewhat irregularly, the sizes of said plates are preferably wide enough so that the veneers 2A and 2B do not stick out from the floor plate (portable platen)). If necessary, a retaining plate similar to the floor plate may be placed on an upper surface of the layered-up veneer board 20 as well.

Once the veneers 2 are layered up to the predetermined height, the controller 70 drives the veneer stacking device 4 to carry the layered-up veneer board 20 to the loading device 10 and drives the loading device 10 and the in-platen conveyor 82*a* (including the unshown lifting device) to carry the layered-up veneer board 20 to the compression device 8. Specifically, the in-platen conveyor 82*a* is driven to be moved by the unshown lifting device to the conveyance position slightly protruding from the upper surface of the lower platen 82, and is driven such that the layered-up veneer board 20 is transferred from the loading device 10 to a predetermined position of the lower platen 82.

Figure 7:
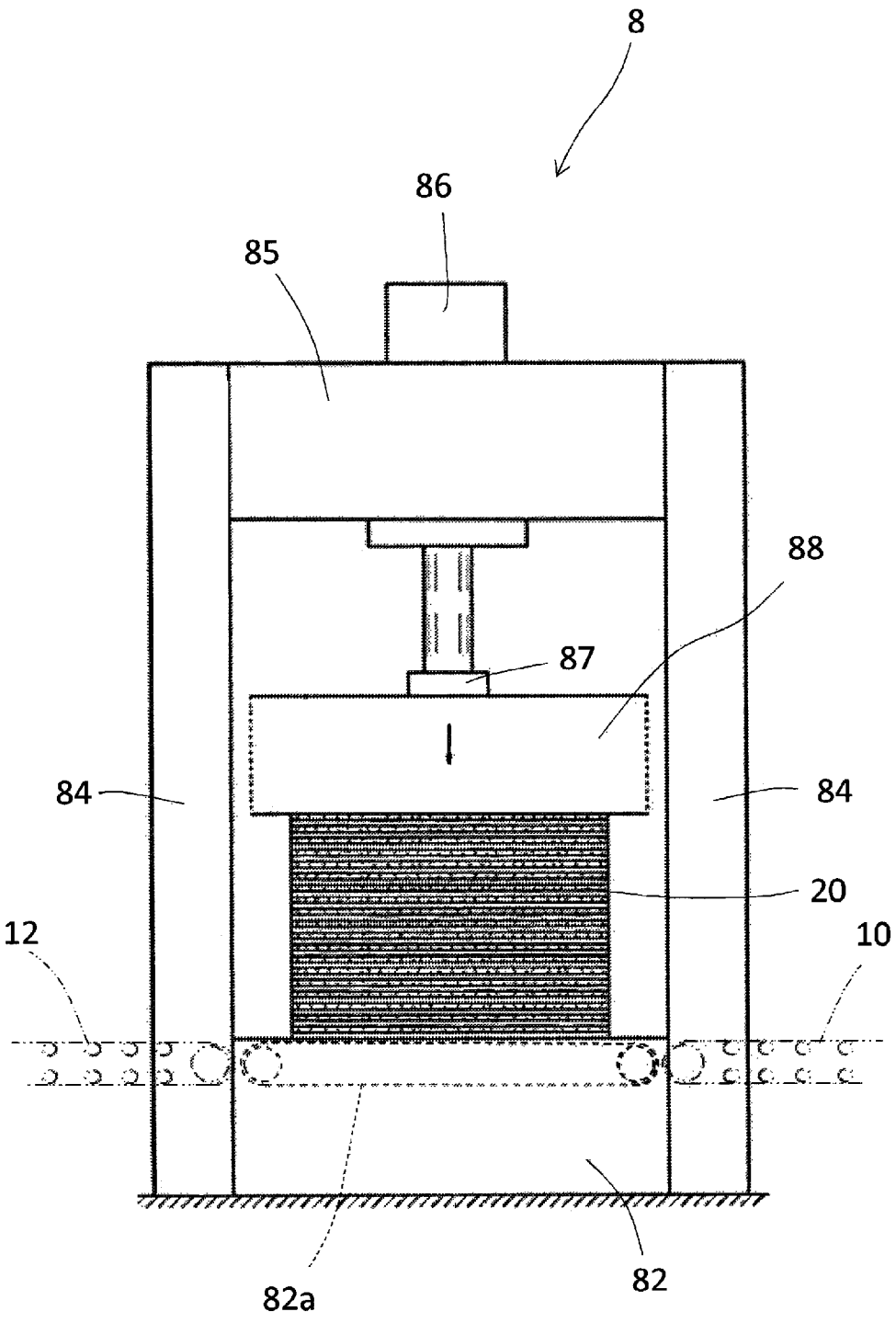
FIG. 7 is an explanatory diagram showing how an upper platen 88 is lowered to compress a layered-up veneer board 20.

Once the layered-up veneer board 20 is carried to the predetermined position of the lower platen 82 of the compression device 8, the controller 70 drives the unshown lifting device such that the in-platen conveyor 82*a* moves to the retraction position lower than the upper surface of the lower platen 82, and drives the activation mechanism 86 to bring the upper platen 88 close to the lower platen 82, as shown in FIG. 7.

Consequently, the layered-up veneer board 20 is compressed between the upper platen 88 and the lower platen 82 in the layering direction, thereby removing moisture contained in each veneer 2. Wood such as the veneers 2 is an anisotropic material in which the tensile strength in the same direction as the fiber direction of said material is higher than the tensile strength in the direction perpendicular to the fiber direction. Therefore, when compressing the layered-up veneer board 20 in the layering direction, the layered-up veneer board 20 having the veneers 2 layered such that the fiber directions of the respective veneers 2 are perpendicular to one another, stretching of the veneer 2A in the direction intersecting with the fiber direction thereof can favorably be reduced by the relatively high tensile strength in the fiber direction of the veneer 2B which is in frictional contact (static friction) with the veneer 2A, and stretching of the veneer 2B in the direction intersecting with the fiber direction thereof can favorably be reduced by the relatively high tensile strength in the fiber direction of the veneer 2A which is in frictional contact (static friction) with the veneer 2B.

In the present embodiment, the abovementioned effect of inhibiting elongational deformation acts on both the front and rear surfaces of all the veneers 2 other than the top and bottom veneers 2 out of the veneers 2 constituting the layered-up veneer board 20 so that adjacent veneers 2 inhibit each other from stretching and becoming deformed in the direction perpendicular to their fiber direction. Therefore, elongational deformation in the directions perpendicular to the fiber directions can effectively be reduced. As to the top and bottom veneers 2 out of the veneers 2 constituting the layered-up veneer board 20, the abovementioned effect of inhibiting elongational deformation acts on either the front surfaces or the rear surfaces to reduce elongational deformation of these top and bottom veneers 2 in the directions perpendicular to the fiber directions, but elongational deformation of the other surfaces in the directions perpendicular to the fiber directions is reduced by the frictional force between the veneer 2 and the upper platen 88 or the lower platen 82.

According to the veneer dehydration system 1 of the foregoing embodiment of the invention, in spite of such an extremely simple configuration in which the veneers 2 are layered such that the fiber directions of the respective veneers 2 are perpendicular to one another, elongational deformation of each of the veneers 2 of the layered-up veneer board 20 in the direction perpendicular to its fiber direction can be reduced, thereby effectively reducing cracking of the veneers 2 attributed to such elongational deformation.

Furthermore, according to the veneer dehydration system 1 of the foregoing embodiment of the invention, even if the shapes of the veneers 2 such as the lengths of the respective sides of each veneer 2 and the angles of cut of the respective sides are somewhat non-uniform, or even if the veneers 2 are layered slightly off, the veneers 2 adjacent to each other prevent each other from stretching and becoming deformed in the directions perpendicular to their fiber directions. Therefore, the formation of cracks in each veneer 2 attributed to elongational deformation thereof can favorably be reduced. Since the shape accuracy of the veneers 2 and the accuracy of layering the veneers 2 do not need to be exceptionally precise, the veneer dehydration system 1 of the present invention is excellent in practicality. Even if the outer peripheries of some of the veneers 2 do not overlap properly with each other and therefore cannot be dehydrated adequately by the compression device 8 due to poor shapes or poor layering of such veneers 2, since the outer peripheries of the veneers 2 tend to k more easily than the other parts of the veneers 2, the veneers 2 can be dehydrated adequately in the subsequent heat-king step. For this reason, poor shapes and poor layering of the veneers 2 are practically not obstacles.

Figure 9:
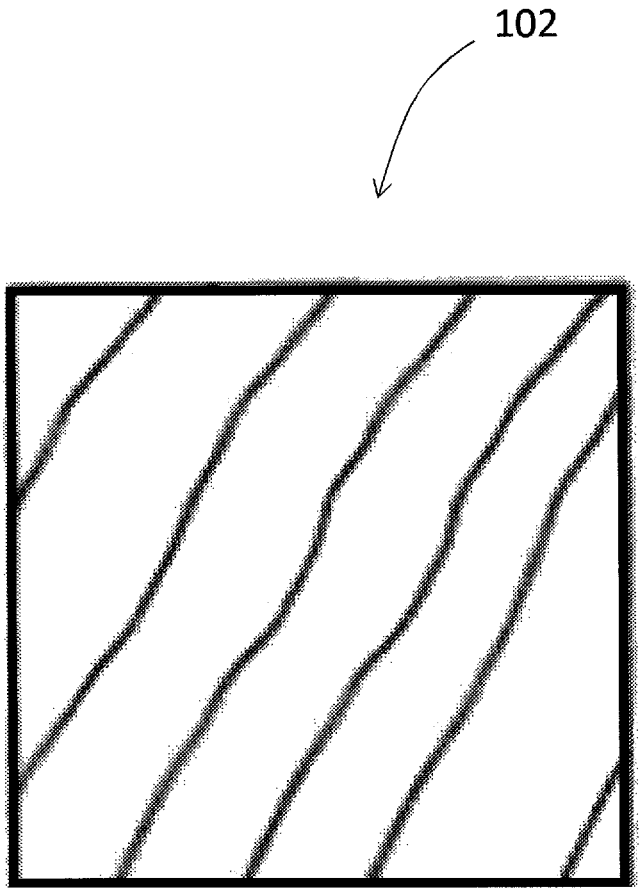
FIG. 9 is a plan view showing the exterior of a veneer 102 of a modification.

Although, in the present embodiment, the veneers 2 are layered such that the fiber directions of the respective veneers 2 are perpendicular to one another, how the fiber directions are arranged is not limited to such perpendicular arrangement so long as the fiber directions of the respective veneers 2 intersect with one another. When cutting a log with a veneer lathe to obtain the veneers 2, it is rare for the direction of the edge of the knife cutting the log to be parallel to the fiber direction of the log. Specifically, in most cases, as shown in a veneer 102 of a modification in FIG. 9, the fiber direction of a veneer such as the veneer 102 forms an angle with each of the sides of the veneer 102 defining the outer periphery of the veneer 102.

Figure 10:
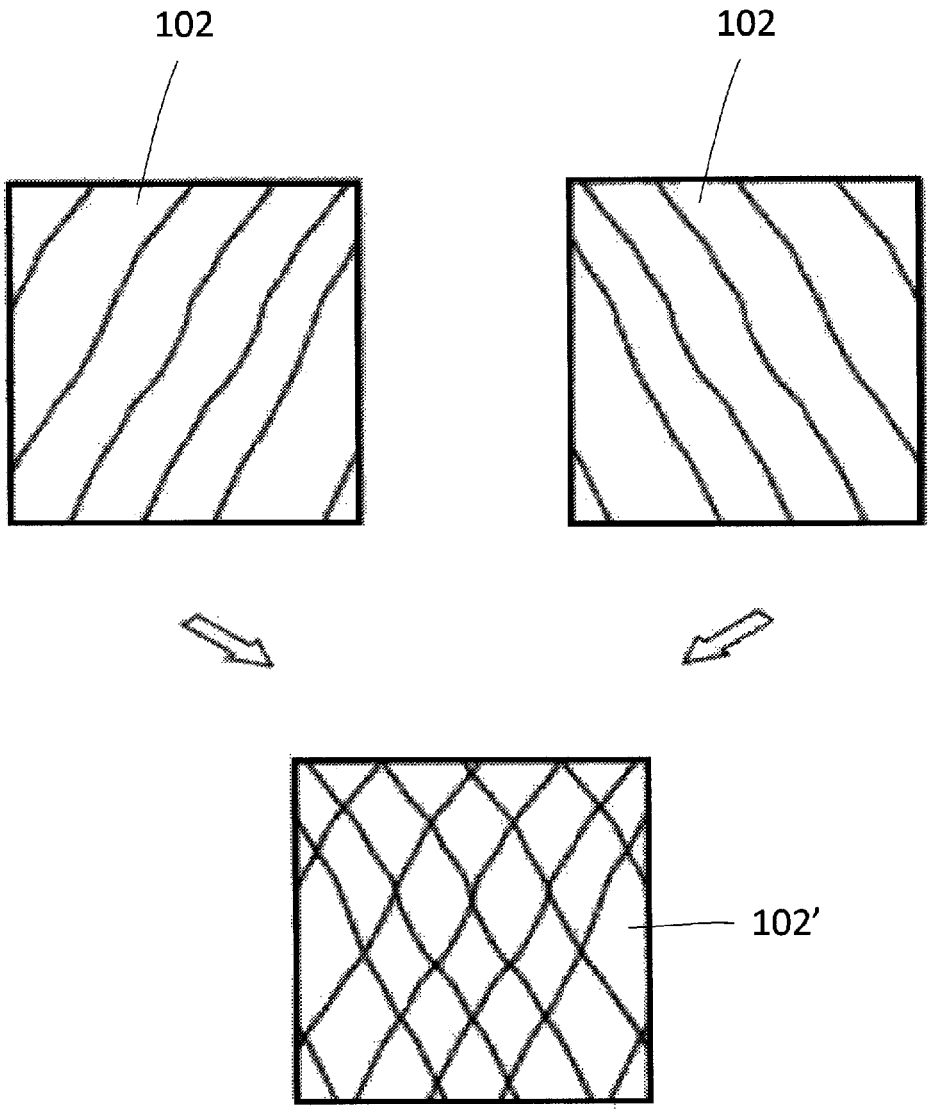
FIG. 10 is an explanatory diagram showing how a layered body 102' is formed by veneers 102 of a modification.

In order to form a layered-up veneer board 120 using veneers 102, the veneers 102 can be layered, with the front and rear sides of the respective veneers 102 reversed, so that the fiber directions of the respective veneers 102 intersect with one another, as shown in FIG. 10. In so doing, in place of the conveying device 6 described above, a conveying device 106 of a modification shown in FIG. 11 may be used.

Figure 11:
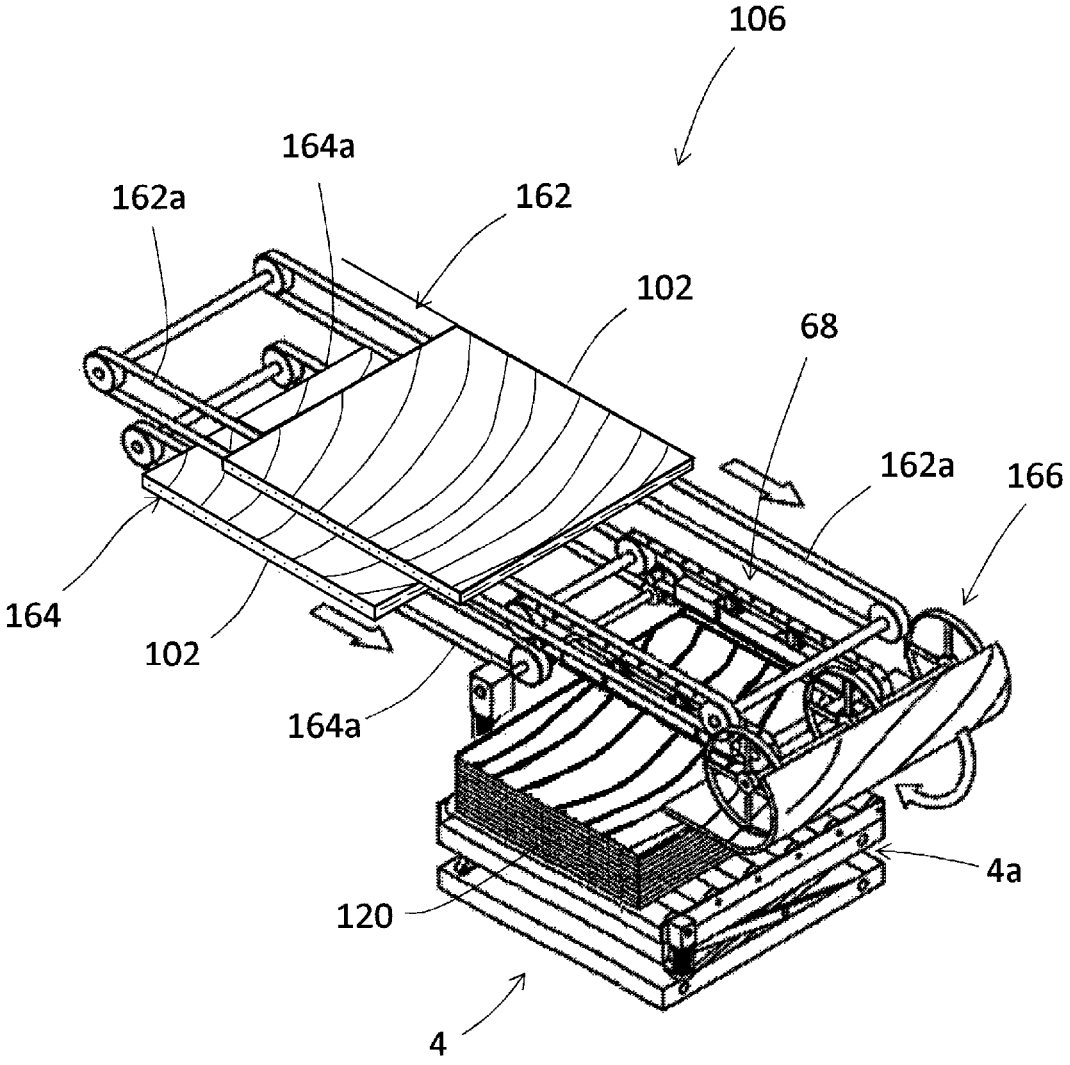
FIG. 11 is a perspective view showing an outline of a configuration of a conveying device 106 of a modification.

As shown in FIG. 11, the conveying device 106 has an upper conveying line 162, a lower conveying line 164 disposed immediately below the upper conveying line 162, a reversing mechanism 166, and a needle belt conveyor 68. The upper conveying line 162 is configured as a belt conveyor having a pair of belts 162*a* and 162*a* and is long enough to cross the veneer stacking device 4. The upper conveying line 162 and the lower conveying line 164 are, respectively, examples of implementation configurations corresponding to the "first conveying device" and the "second conveying device" of the invention.

As shown in FIG. 11, the lower conveying line 164 is configured as a belt conveyor having a pair of belts 164*a* and 164*a* and is shorter than the upper conveying line 162 in the conveyance direction. Specifically, the lower conveying line 164 has a length reaching a part immediately before the veneer stacking device 4. The veneers 102 having their fiber directions arranged in the same direction are loaded onto the upper conveying line 162 and the lower conveying line 164.

As shown in FIG. 11, the reversing mechanism 166 is disposed at the end of the upper conveying line 162 to reverse each of the veneers 102 carried by the upper conveying line 162, and transfer each of the veneers 102 to the veneer stacking device 4.

It is preferred that the needles of the needle belt conveyor 68 each have a length equivalent to the thickness of two or more sheets of veneers 102.

Using the conveying device 106 configured as above, the veneers 102 are layered such that the fiber directions of the respective veneers 102 intersect with one another to form a layered body 102' as shown in FIG. 10. Then, a layered-up veneer board 120 having a predetermined height is formed by layering such layered bodies 102' up to the predetermined height. Note that the veneer stacking device 4 is configured to be able to convey the layered-up veneer board 120 to the loading device 10.

According to the present embodiment and the foregoing modifications, the layered-up veneer board 20 is formed by layering the veneers 2 such that the fiber directions of the respective veneers 2 are perpendicular to one another; however, other configurations are possible. For example, as shown in a modification in FIG. 12, a layered body 202' may be formed by layering a pair of veneers 202B and 202B on one veneer 202A having the fiber direction thereof extending in a predetermined direction, such that the fiber direction of the pair of veneers 202B and 202B intersects with (is perpendicular to) the fiber direction of the veneer 202A, and then the layered body 202' may repeatedly be layered up to a predetermined height, to form a layered-up veneer board 220. In other words, the layered-up veneer board 220 is formed by repeatedly and alternately layering the single veneer 202A and the pair of veneers 202B and 202B in the layering direction, with the fiber direction of the pair of veneers 202B and 202B intersecting with (perpendicular to) the fiber direction of the veneer 202A.

Figure 13:
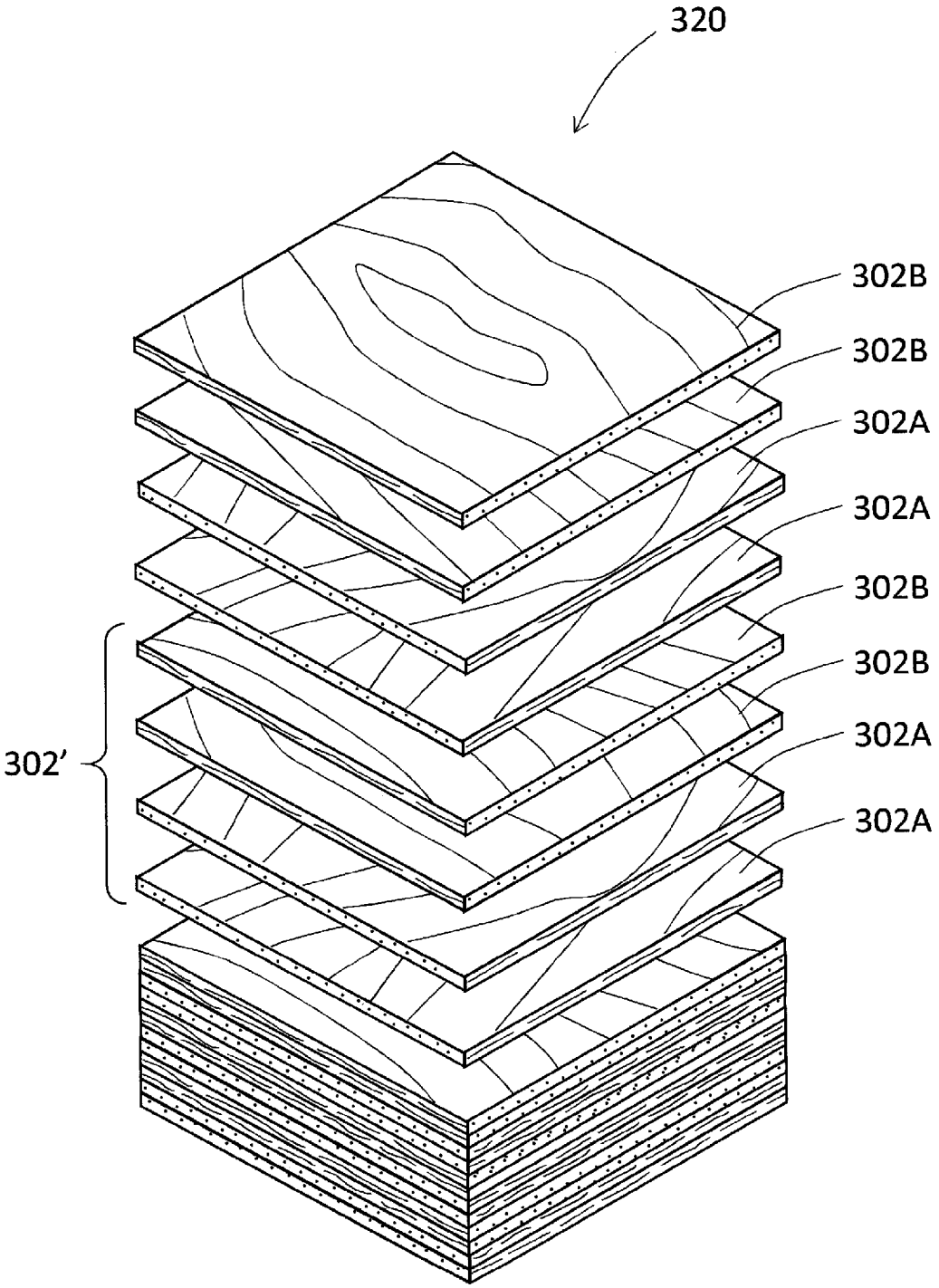
FIG. 13 is an exploded perspective view showing a part of a layered-up veneer board 320 of a modification.

As shown in a modification in FIG. 13, a layered body 302' may be formed by layering a pair of veneers 302B and 302B on a pair of veneers 302A and 302A having the fiber direction thereof extending in a predetermined direction, such that the fiber direction of the pair of veneers 302B and 302B intersects with (is perpendicular to) the fiber direction of the pair of veneers 302A and 302A, and then the layered body 302' may repeatedly be layered up to a predetermined height, to form a layered-up veneer board 320. In other words, the layered-up veneer board 320 is formed by layering the veneers 302A and 302B such that the fiber directions of the respective veneers intersect with each other (are perpendicular to each other) every two layers. More specifically, the layered-up veneer board 320 is formed by repeatedly and alternately layering the pair of veneers 302A and 302A and the pair of veneers 302B and 302B in the layering direction, the fiber direction of the pair of veneers 302B and 302B intersecting with (being perpendicular to) the fiber direction of the pair of veneers 302A and 302A.

Figure 14:
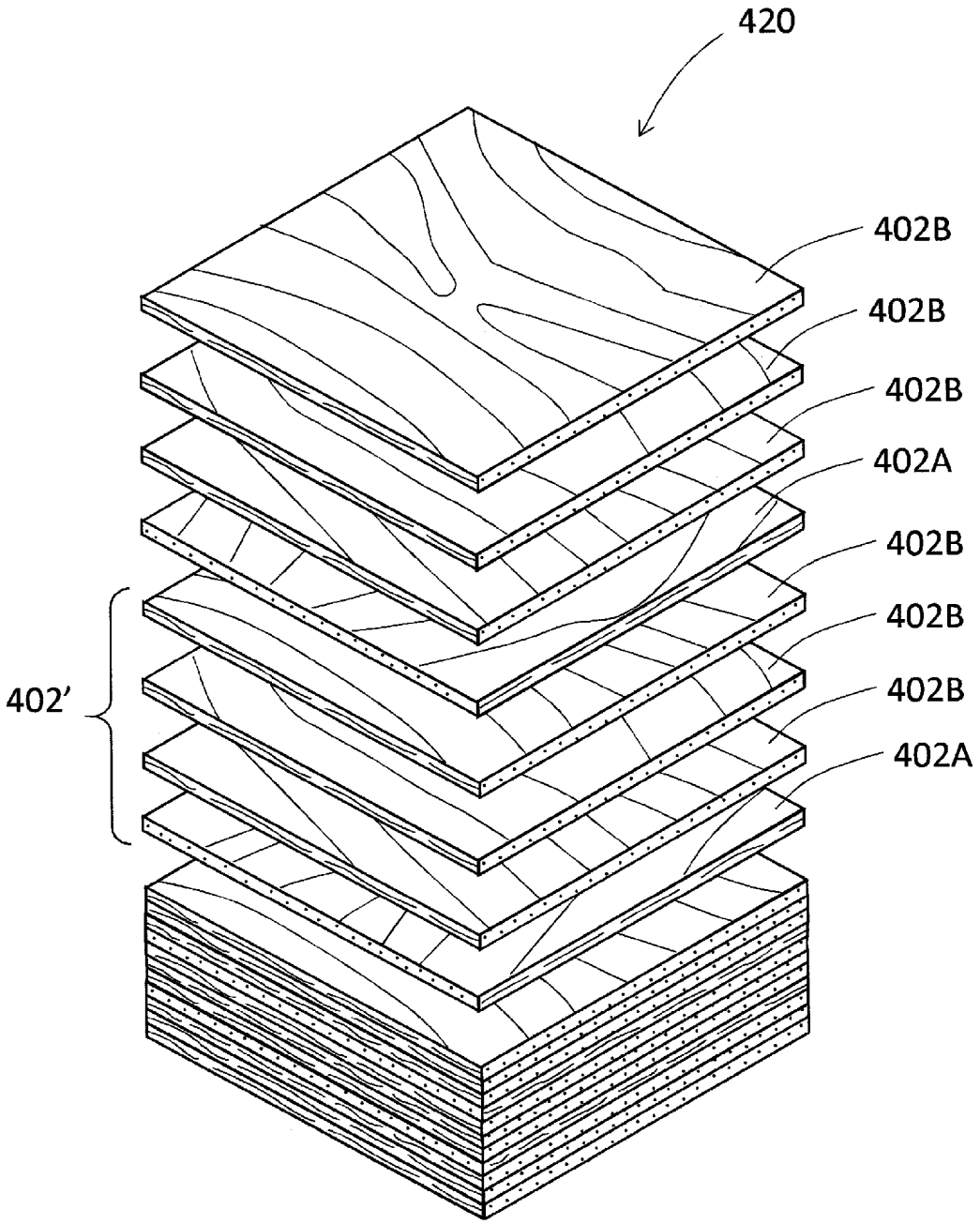
FIG. 14 is an exploded perspective view showing a part of a layered-up veneer board 420 of a modification.

Further, as shown in a modification in FIG. 14, a layered body 402' may be formed by layering three veneers 402B, 402B and 402B on one veneer 402A having the fiber direction thereof extending in a predetermined direction, such that the fiber direction of the set of veneers 402B, 402B and 402B intersects with (is perpendicular to) the fiber direction of the veneer 402A, and then the layered body 402' may repeatedly be layered up to a predetermined height, to form a layered-up veneer board 420. In other words, the layered-up veneer board 420 is formed by repeatedly and alternately layering the single veneer 402A and the set of three veneers 402B, 402B and 402B in the layering direction, with the fiber direction of the set of veneers 402B, 402B and 402B intersecting with (perpendicular to) the fiber direction of the veneer 402A.

Figure 15:
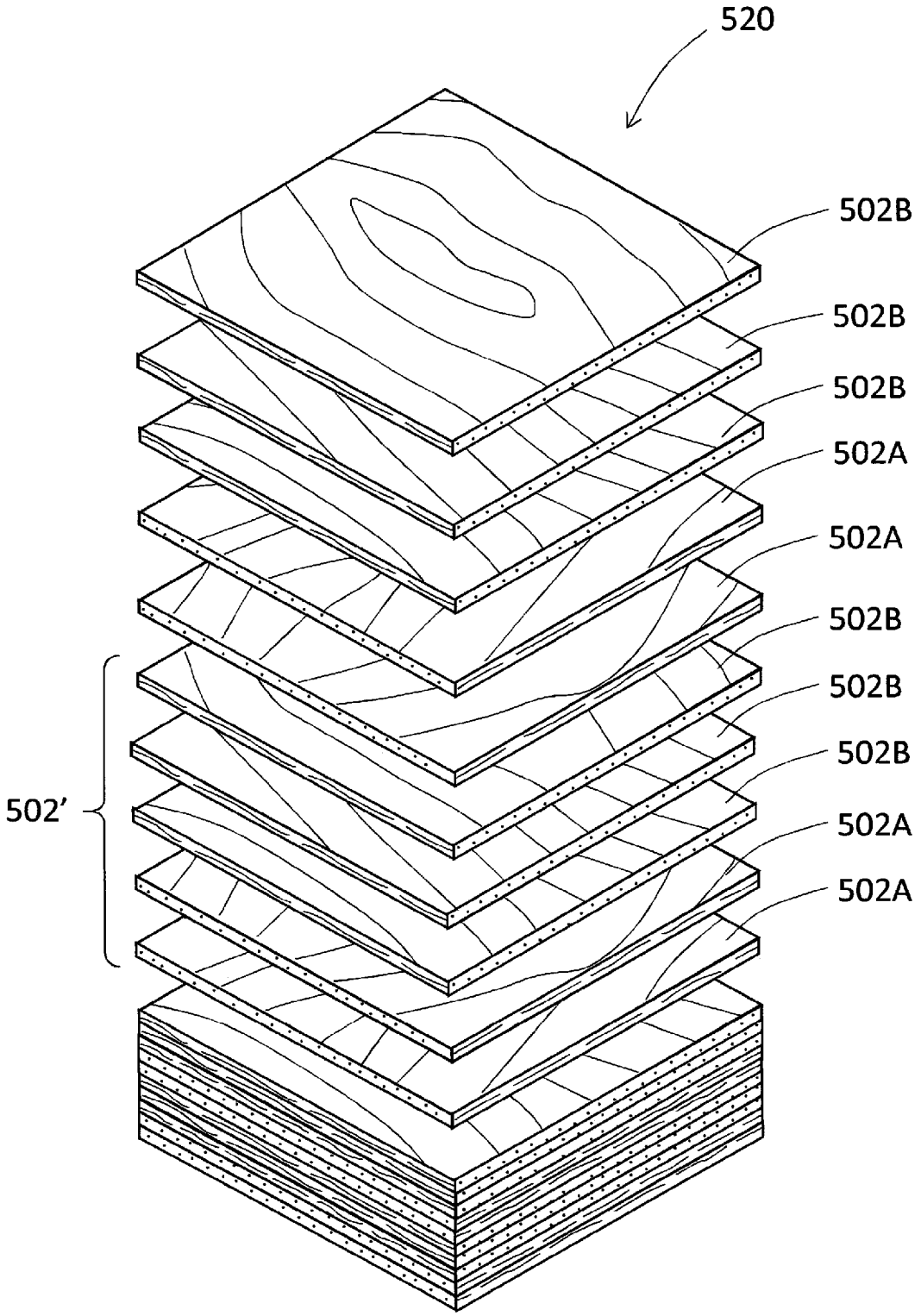
FIG. 15 is an exploded perspective view showing a part of a layered-up veneer board 520 of a modification.

As shown in a modification in FIG. 15, a layered body 502' may be formed by layering a set of three veneers 502B, 502B and 502B on a pair of veneers 502A and 502A having the fiber direction thereof extending in a predetermined direction, such that the fiber direction of the set of three veneers 502B, 502B and 502B intersects with (is perpendicular to) the fiber direction of the pair of veneers 502A and 502A, and then the layered body 502' may repeatedly be layered up to a predetermined height, to form a layered-up veneer board 520. In other words, the layered-up veneer board 520 is formed by repeatedly and alternately layering the pair of veneers 502A and 502A and the set of three veneers 502B, 502B and 502B in the layering direction, with the fiber direction of the set of veneers 502B, 502B and 502B intersecting with (perpendicular to) the fiber direction of the pair of veneers 502A and 502A.

Figure 16:
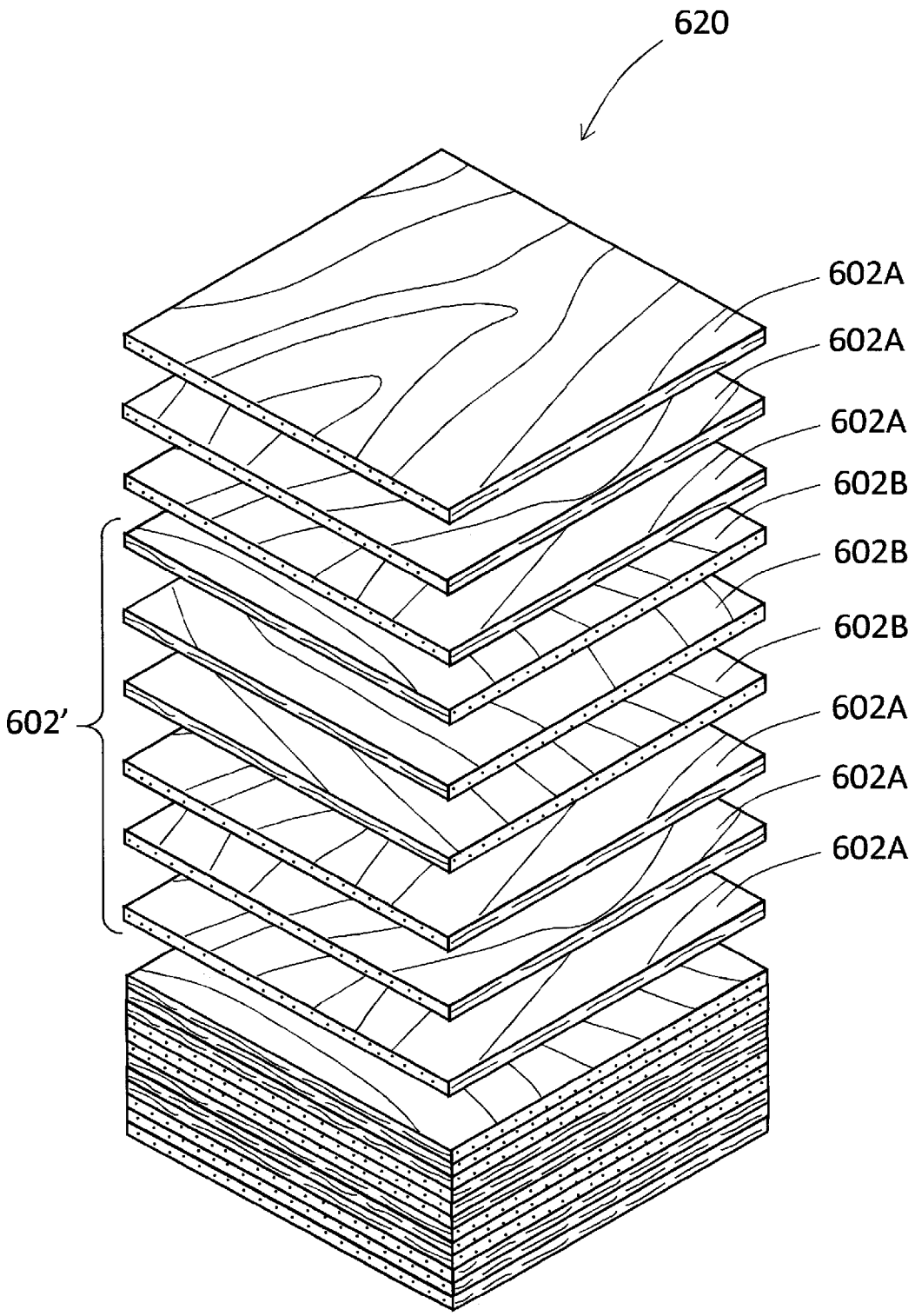
FIG. 16 is an exploded perspective view showing a part of a layered-up veneer board 620 of a modification.

Alternatively, as shown in a modification in FIG. 16, a layered body 602' may be formed by layering a set of three veneers 602B, 602B and 602B on a set of three veneers 602A, 602A and 602A having the fiber direction thereof extending in a predetermined direction, such that the fiber direction of the set of three veneers 602B, 602B and 602B intersects with (is perpendicular to) the fiber direction of the set of three veneers 602A, 602A and 602A, and then the layered body 602' may repeatedly be layered up to a predetermined height, to form a layered-up veneer board 620. In other words, the layered-up veneer board 620 is formed by layering the veneers 602A and 602B such that the fiber directions of the respective veneers 602A and 602B intersect with each other (are perpendicular to each other) every three layers. More specifically, the layered-up veneer board 620 is formed by repeatedly and alternately layering the set of three veneers 602A, 602A and 602A and the set of three veneers 602B, 602B and 602B in the layering direction, with the fiber direction of the set of three veneers 602B, 602B and 602*b* intersecting with (perpendicular to) the fiber direction of the set of three veneers 602A, 602A and 602A.

Figure 12:
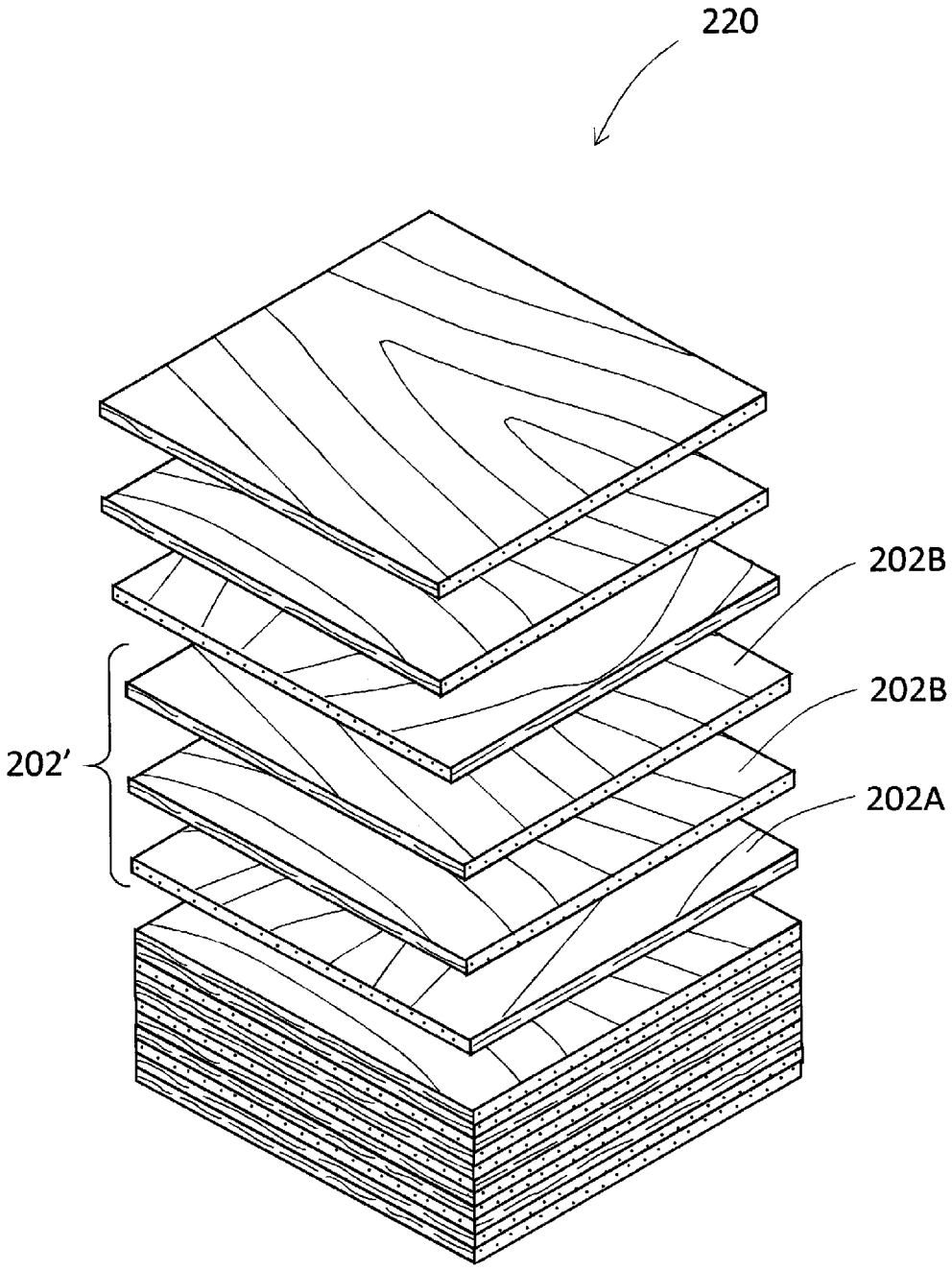
FIG. 12 is an exploded perspective view showing a part of a layered-up veneer board 220 of a modification.

As to all the veneers 202A, 202B, 302A, 302B other than the top and bottom veneers 202A, 202B, 302A, and 302B out of the veneers 202A, 202B, 302A, and 302B constituting the layered-up veneer boards 220 and 320 of the modifications shown in FIGS. 12 and 13, the veneers 202B, 202A, 302B, and 302A with the intersecting (perpendicular) fiber directions are disposed adjacent to either the front surfaces or the rear surfaces of said veneers other than the top and bottom veneers. For this reason, although the veneers 202A, 202B, 302A, 302B stretch and become deformed in the directions perpendicular to the respective fiber directions, when compressing the layered-up veneer boards 220 and 320 in the layering direction, stretching of the veneers 202A, 302A in the directions intersecting with the fiber directions thereof is favorably reduced by the relatively high tensile strengths in the fiber direction of the veneers 202B, 302B in frictional contact (static friction) with the veneers 202A, 302A. At the same time, stretching of the veneers 202B, 302B in the directions intersecting with the fiber directions thereof is favorably reduced by the relatively high tensile strength in the fiber directions of the veneers 202A, 302A in frictional contact (static friction) with the veneers 202B, 302B.

As to the top and bottom veneers 202A, 202B, 302A, 302B of the veneers 202A, 202B, 302A, and 302B constituting the layered-up veneer boards 220 and 320, elongational deformation of either the front surfaces or the rear surfaces of said top and bottom veneers in the directions perpendicular to the respective fiber directions thereof is reduced by the frictional force between the upper platen 88 or the lower platen 82 and said front or rear surfaces.

In the layered-up veneer boards 420, 520, and 620 of the modifications shown in FIGS. 14, 15 and 16, between the veneers 402A, 502A, 602A and the veneers 402B, 502B, 602B disposed on either the front surfaces or the rear surfaces of the veneers 402A, 502A, 602A such that the fiber directions of the veneers 402B, 502B, 602B intersect with (are perpendicular to) the fiber directions of the veneers 402A, 502A, 602A, stretching of the veneers 402A, 502A, 602A in the directions intersecting with the fiber directions thereof is favorably reduced by the relatively high tensile strength in the fiber directions of the veneers 402B, 502B, 602B in frictional contact (static friction) with the veneers 402A, 502A, 602A. At the same time, stretching of the veneers 402B, 502B, 602B in the directions intersecting with the fiber directions thereof is favorably reduced by the relatively high tensile strength in the fiber directions of the veneers 402A, 502A, 602A in frictional contact (static friction) with the veneers 402B, 502B, 602B. Between the veneers 402B, 502B, 602B, i.e., between two veneers 402B, 502B, 602B adjacent respectively to the veneer 402A, 502A, 602A closest thereto and the veneer 402B, 502B, 602B disposed between said two veneers 402B, 502B, 602B, the aforementioned effect of reducing elongational deformation that acts between the veneers 402A, 502A, 602A and said two veneers 402B, 502B, 602B adjacent respectively to the veneers 402A, 502A, 602A also acts on the veneer 402B, 502B, 602B disposed between said two veneers 402B, 502B, 602B, thereby reducing elongational deformation of the veneer 402B, 502B, 602B between said two veneers 402B, 502B, 602B in the direction intersecting with (perpendicular to) the fiber directions thereof. Note that elongational deformation of either the front surfaces or the rear surfaces of the top and bottom veneers 402A, 402B, 502A, 502B, 602A, 602B in the directions perpendicular to the fiber directions thereof is reduced by the frictional force between the upper platen 88 or the lower platen 82 and said front or rear surfaces.

Thus, even when stress is applied to the veneers 402A, 402B, 502A, 502B, 602A, 602B and causes elongational deformation of these veneers in the directions perpendicular to the fiber directions thereof as a result of compressing the layered-up veneer boards 420, 520, 620 of the modifications in the layering direction, elongational deformation of the veneers 402A, 402B, 502A, 502B, 602A, 602B in the directions intersecting with (perpendicular to) the fiber directions thereof can favorably be reduced. The practical number of veneers to be stacked with the fiber directions thereof aligned in the same direction, is preferably determined on the basis of an experiment in line with the thickness of each veneer, the condition of the front surface of each veneer (cracking or separation of wood fibers upon cutting with a veneer lathe), and other substances (conditions) of each veneer.

The layered-up veneer boards 220, 320, 420, 520, 620 of the modifications can be formed using the conveying device 6 and the veneer stacking device 4 shown in FIG. 5. Specifically, in order to form the layered-up veneer board 220, the pair of layered-up veneer boards 202B and 202B may be fed to the upper conveying line 62 and the single veneer 202A having the fiber direction thereof intersecting with (perpendicular to) the fiber direction of the pair of veneers 202B and 202B may be fed to the lower conveying line 64. In order to form the layered-up veneer board 320, the pair of layered-up veneer boards 302B and 302B may be fed to the upper conveying line 62 and the pair of veneers 302A and 302A having the fiber direction thereof intersecting with (perpendicular to) the fiber direction of the pair of veneers 302B and 302B may be fed to the lower conveying line 64.

Also, in order to form the layered-up veneer board 420, the set of three layered-up veneer boards 402B, 402B and 402B may be fed to the upper conveying line 62, and the single veneer 402A having the fiber direction thereof intersecting with (perpendicular to) the fiber direction of the set of three veneers 402B, 402B and 402B may be fed to the lower conveying line 64. Further, in order to form the layered-up veneer board 520, the set of three layered-up veneer boards 502B, 502B and 502B may be fed to the upper conveying line 62, and the pair of veneers 502A and 502A having the fiber direction thereof intersecting with (perpendicular to) the fiber direction of the set of three veneers 502B, 502B and 502B may be fed to the lower conveying line 64. In order to form the layered-up veneer board 620, the set of three layered-up veneer boards 602B, 602B and 602B may be fed to the upper conveying line 62, and the set of three veneers 602A, 602A and 602A having the fiber direction thereof intersecting with (perpendicular to) the fiber direction of the set of three veneers 602B, 602B and 602B may be fed to the lower conveying line 64.

Figure 17:
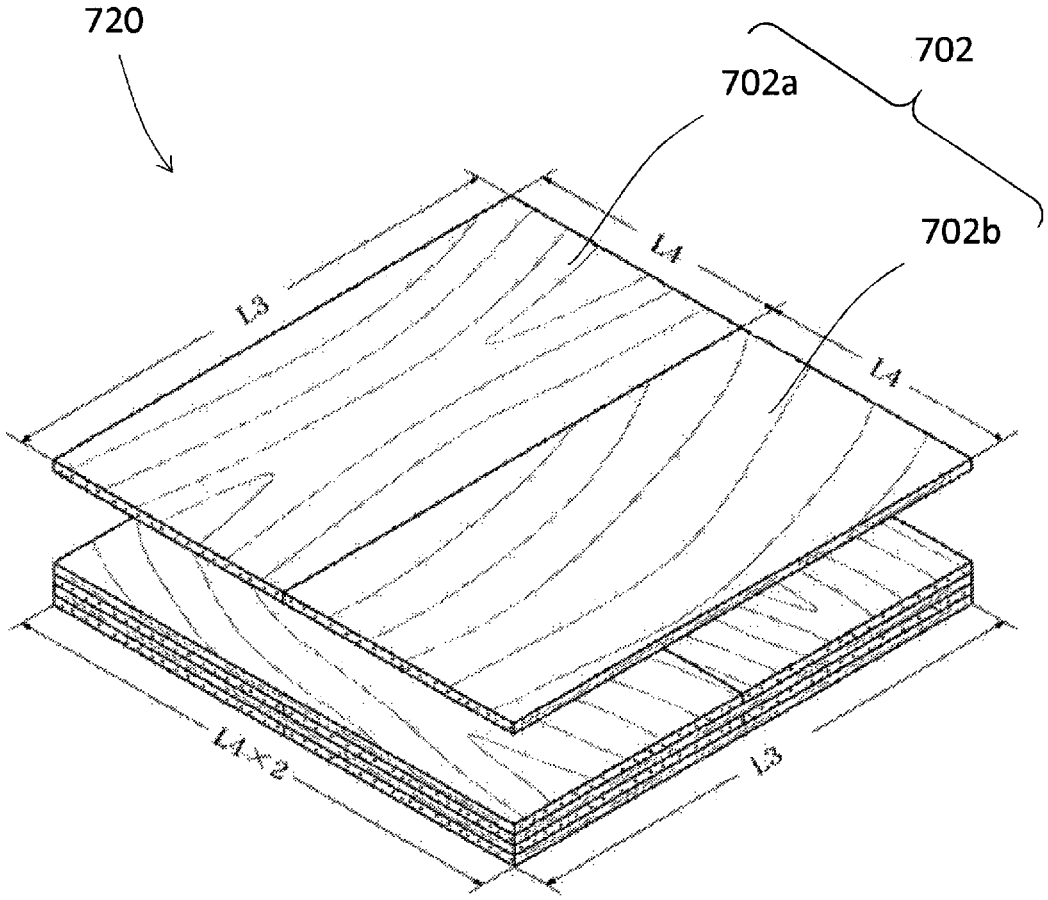
FIG. 17 is an explanatory diagram showing how a layered-up veneer board 720 is formed using veneers 702 of a modification.

According to the present embodiment and the foregoing modifications, the standard-size veneers 2, 102, 202A, 202B, 302A, 302B, 402A, 402B, 502A, 502B, 602A, 602B, which are each in a square shape when viewed from the direction perpendicular to the primary surfaces of said veneers, are formed by cutting a continuous, strip-like veneer with no unnecessary parts into a predetermined standard length or by bringing the rectangular narrow veneers 2*a*, 2*b*, and 2*c* tightly or very closely together, the narrow veneers having most or all of unnecessary parts removed, and then cutting the veneers 2*a*, 2*b* and 2*c* into a predetermined standard length; however, other configurations are possible. For example, a veneer 702 of a modification shown in FIG. 17, which is in a square shape when viewed from the direction perpendicular to the primary surface of said veneer, may be formed by bringing tightly or very closely together rectangular veneers 702*a* and 702*b* each having the long side approximately twice as long as the short side when viewed from the direction perpendicular to the primary surface thereof, with the fiber directions thereof aligned. The veneers 702*a* and 702*b* can be joined using a joining material such as a joining tape, an adhesive, or staples.

In order to remove moisture contained in the veneer 702, a desired number of (including one) veneers 702, layered, are loaded onto the upper conveying line 62 of the conveying device 6, and then a desired number of (including one) veneers 702, layered, are loaded onto the lower conveying line 64, with the fiber direction thereof intersecting with (perpendicular to) the fiber direction of the veneers 702 loaded onto the upper conveying line 62, thereby obtaining a layered-up veneer board 720 (see FIG. 17) in which the fiber directions of the veneers 702 intersect with (are perpendicular to) each other every desired number of veneers, and then the layered-up veneer board 720 is compressed by the compression device 8.

Figure 18:
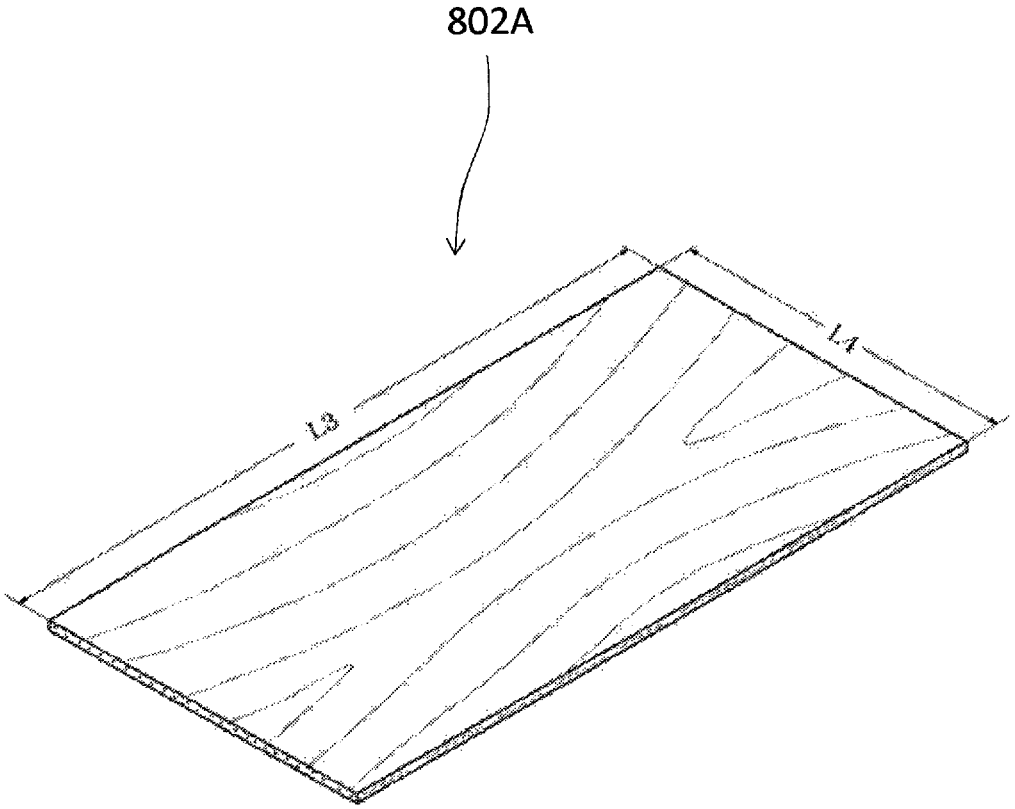
FIG. 18 is a perspective view showing the exterior of a standard-size veneer 802A of a modification.
Figure 19:
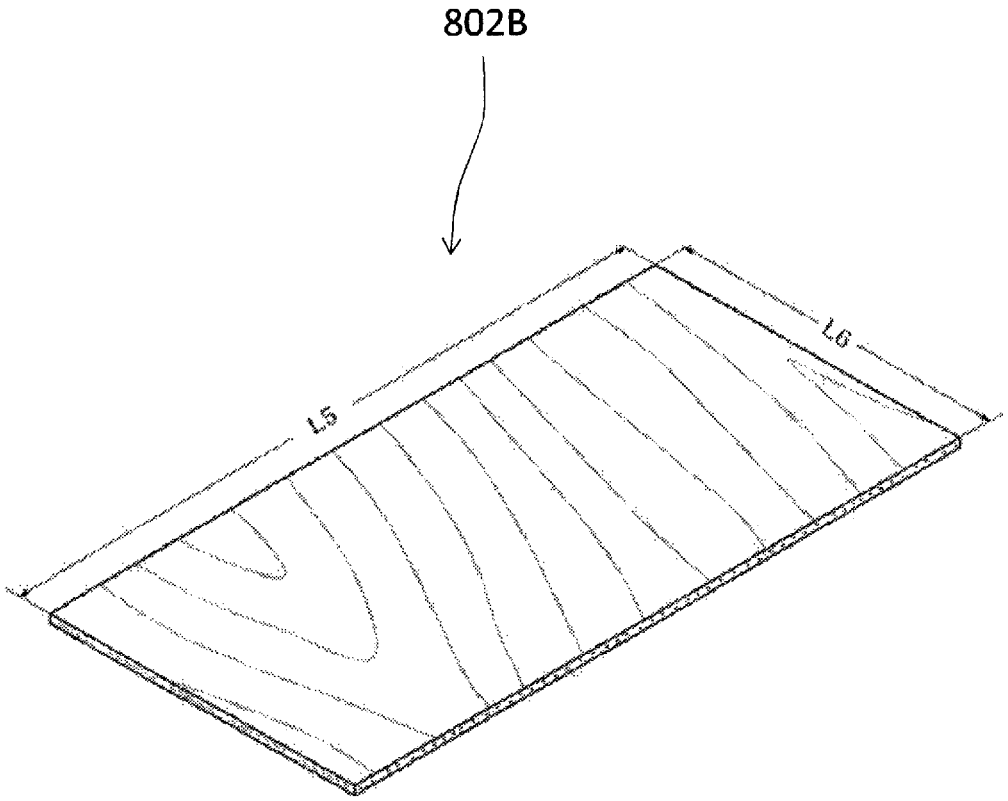
FIG. 19 is a perspective view showing the exterior of a standard-size veneer 802B of a modification.

The present embodiment and the foregoing modifications use the standard-size veneers 2, 102, 202A, 202B, 302A, 302B, 402A, 402B, 502A, 502B, 602A, 602B, which are each in a square shape when viewed from the direction perpendicular to the primary surfaces thereof; however, other configurations are possible. For example, as shown in FIGS. 18 and 19, standard-size veneers 802A and 802B that are each in a rectangular shape when viewed from the direction perpendicular to the primary surfaces thereof may be used. As shown in FIG. 18, the standard-size veneer 802A is formed such that the fiber direction thereof is roughly the same as the extending direction of the long side of the veneer 802A, whereas, as shown in FIG. 19, the standard-size veneer 802B is formed such that the fiber direction thereof is roughly the same as the extending direction of the short side of the veneer 802B.

Figure 20:
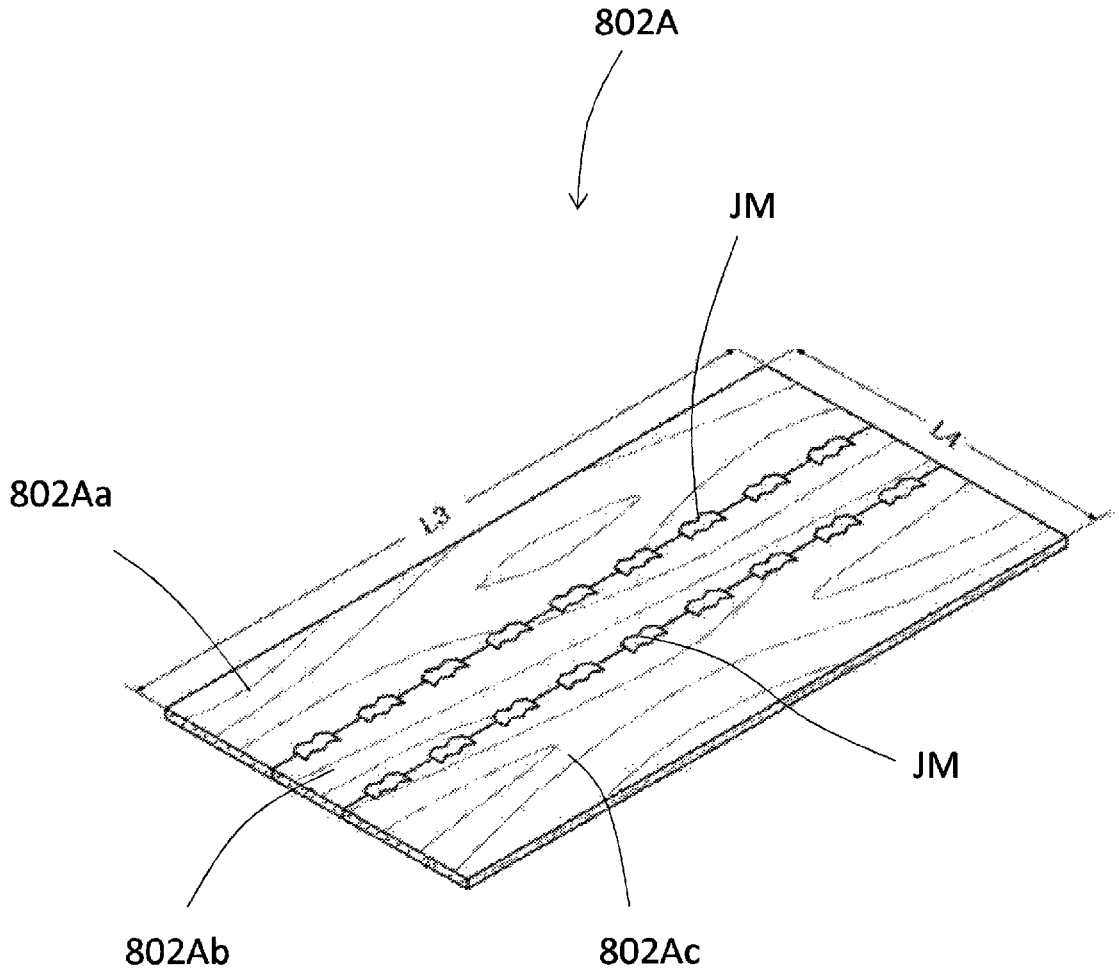
FIG. 20 is a perspective view showing the exterior of the standard-size veneer 802A formed by bringing narrow veneers 802Aa, 802Ab and 802Ac together and joining the veneers 802Aa, 802Ab and 802Ac using a joining material.
Figure 21:
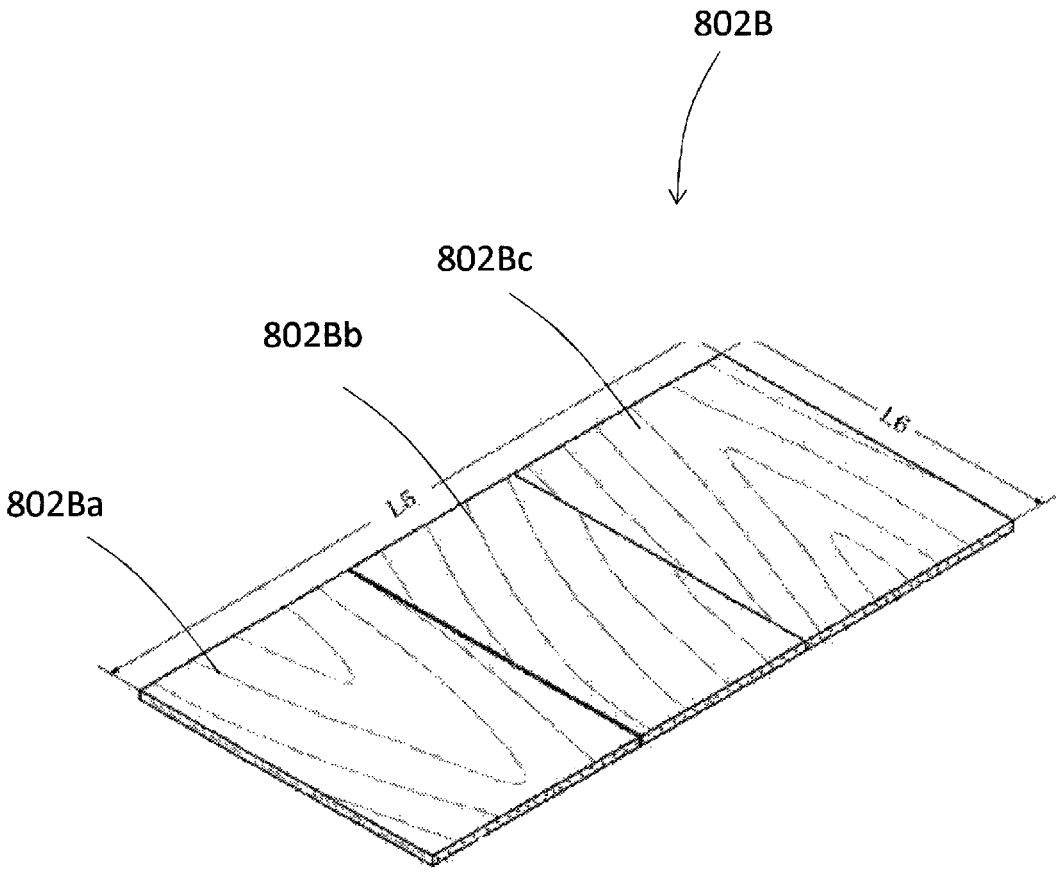
FIG. 21 is a perspective view showing the exterior of the standard-size veneer 802B formed by bringing narrow veneers 802Ba, 802Bb and 802Bc together.

Also, as shown in FIGS. 20 and 21, the standard-size veneers 802A and 802B may be formed by bringing rectangular, narrow veneers 802Aa, 802Ab and 802Ac and narrow veneers 802Ba, 802Bb and 802Bc tightly or very closely together, the narrow veneers having most or all of unnecessary parts removed, and then cutting the narrow veneers 802Aa, 802Ab and 802Ac and the narrow veneers 802Ba, 802Bb and 802Bc into a predetermined standard length. The narrow veneers 802Aa, 802Ab and 802Ac and the narrow veneers 802Ba, 80Bb and 802*bc* that are brought tightly or very closely together are preferably joined using the joining material JM such as a joining tape, an adhesive, or staples (see FIG. 20).

Figure 23:
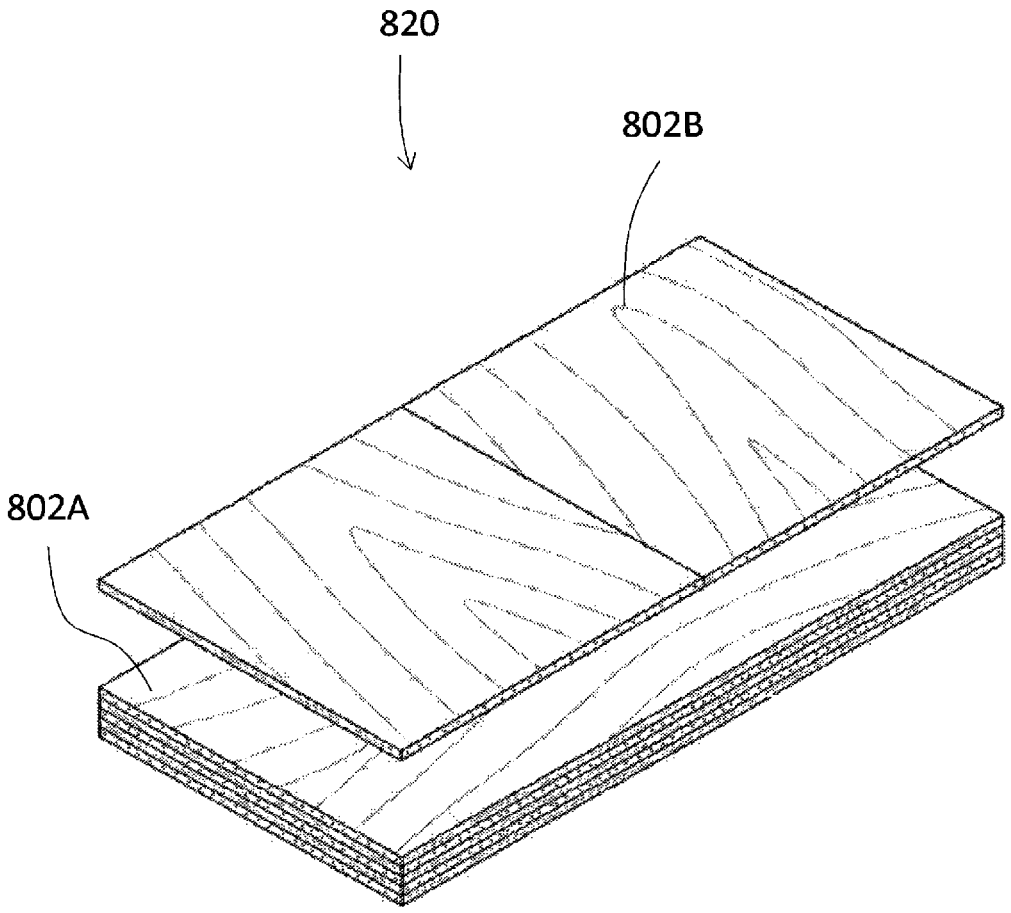
FIG. 23 is an explanatory diagram showing how a laminated veneer 820 is formed using the standard-size veneers 802A and 802B of the modification.

As shown in FIG. 23, the standard-size veneers 802A and 802B may be formed by bringing tightly or very closely together two square veneers with the fiber directions thereof aligned, the square veneers each having the long and short sides roughly equal in length to each other when viewed from the direction perpendicular to the primary surface thereof. The two square veneers can be joined using a joining material such as a joining tape, an adhesive, or staples.

Figure 22:
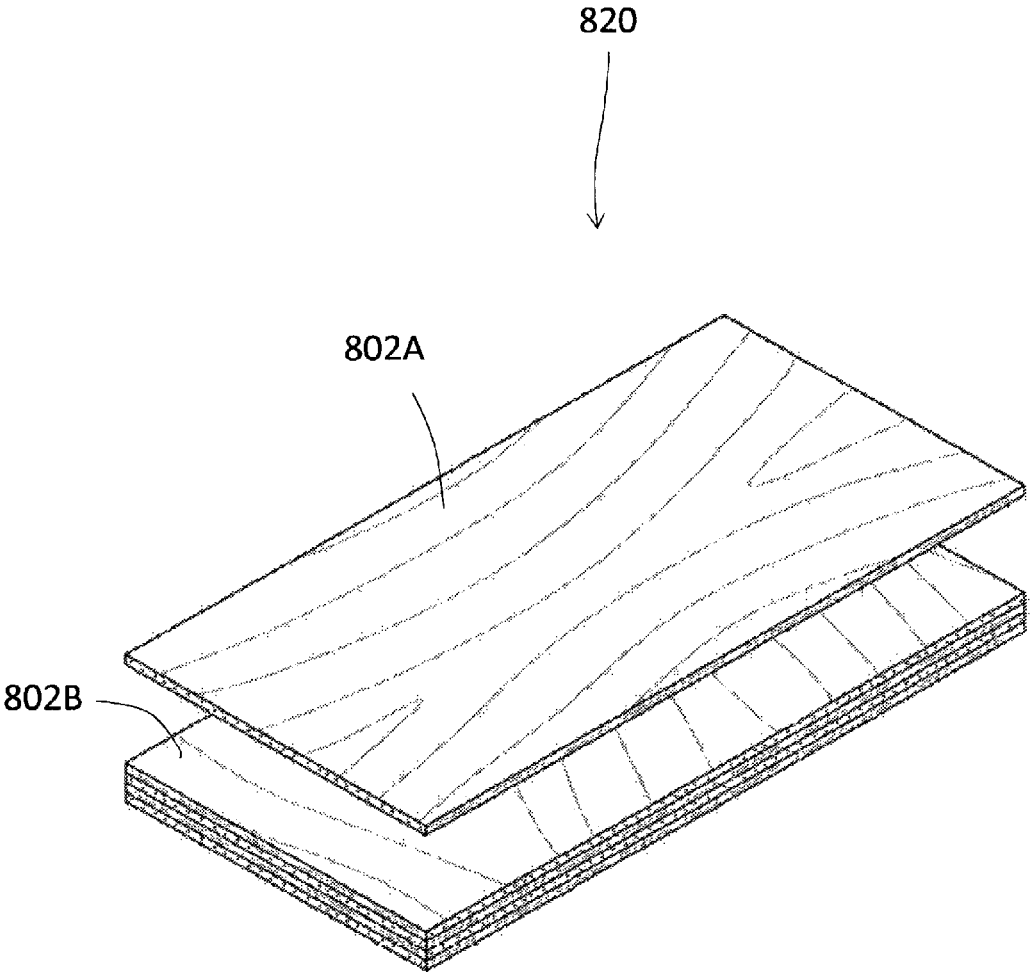
FIG. 22 is an explanatory diagram showing how a layered-up veneer board 820 is formed using the standard-size veneers 802A and 802B of the modifications.

In order to remove moisture contained in the standard-size veneers 802A and 802B configured as above, a desired number of standard-size veneers 802A and a desired number of standard-size veneers 802B may be layered alternately to form a layered-up veneer board 820 as shown in FIG. 22, and then the resultant layered-up veneer board 820 may be compressed by the compression device 8.

Note that, in a case where the standard-size veneers 802A and 802B are each a rectangular veneer of universal dimensions, a conventional method for manufacturing a laminated material, namely a method for manufacturing a laminated veneer material, can be directly used in which a product (a plywood board, a laminated veneer material, etc.) is manufactured by piling multiple standard-size veneers 802A and 802B in a staircase pattern, with the fiber directions thereof aligned every desired number of veneers, and then gluing them together.

According to the present embodiment and the foregoing modifications, the lengths of the sides of each of the veneers 2, 102, 202A, 202B, 302A, 302B, 402A, 402B, 502A, 502B, 602A, 602B, 702*a*, 702*b*, 802A, and 802B are universal; however, the lengths of the sides may be any length.

According to the present embodiment and the foregoing modification, the single layered-up veneer board 20, 120, 220, 320, 420, 520, 620, 720 is compressed by the compression device 8; however, other configurations are possible. Specifically, a plurality of the layered-up veneer boards 20, 120, 220, 320, 420, 520, 620, 720 may be compressed by the compression device 8. In this case, the lower platen 82 and the upper platen 88 may each be formed to have an area roughly equal to or slightly larger than the areas of the veneers 2, 102, 202A, 202B, 302A, 302B, 402A, 402B, 502A, 502B, 602A, 602B, 702, 802A, and 802B. In such a case, it is preferred that a plurality of the activation mechanisms 86 be provided.

Figure 24:
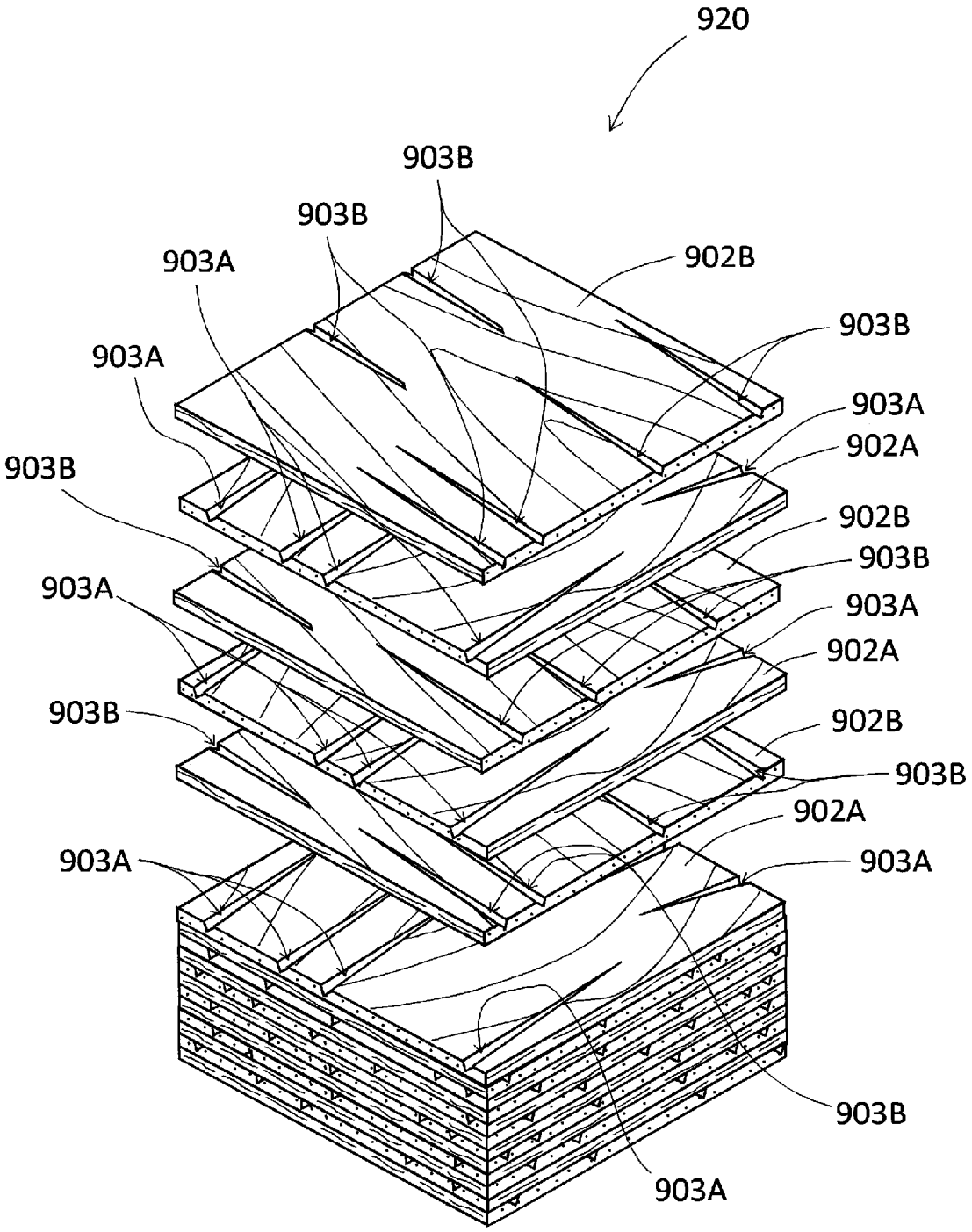
FIG. 24 is an explanatory diagram showing how a layered-up veneer board 920 is formed using standard-size veneers 902A and 902B of modifications.

According to the present embodiment and the foregoing modifications, the veneers 2A, 102, 202A, 302A, 402A, 502A, 602A, 702, and 802A and the veneers 2B, 102, 202B, 302B, 402B, 502B, 602B, 702, and 802B are layered such that the fiber directions on the primary surfaces thereof are perpendicular to one another; however, other configurations are possible. For example, as shown in a layered-up veneer board 920 of a modification in FIG. 24, a veneer 902A and a veneer 902B may be layered in such a manner that the extending direction of lathe checks 903A (cracking caused due to the difference in dimensions between the inner and outer peripheries of a veneer when a rotary lathe thinly cuts a log into a veneer and deforms the resultant veneer into a flat shape) formed in the veneer 902A and the extending direction of lathe checks 903B (cracking caused due to the difference in dimensions between the inner and outer peripheries of a veneer when a rotary lathe thinly cuts a log into a veneer and deforms the resultant veneer into a flat shape) formed in the veneer 902B are perpendicular to the fiber direction of the veneer 902B and the fiber direction of the veneer 902A, respectively.

According to this configuration, when compressing the layered-up veneer board 920, elongational deformation of the veneers 902A in a direction in which the lathe checks 903A expand (the direction intersecting with the fiber direction of the veneers 902A) can favorably be reduced by the relatively high tensile strength in the fiber direction of the veneers 902B in frictional contact (static friction) with the veneers 902A, and elongational deformation of the veneers 902B in a direction in which the lathe checks 903B expand (the direction intersecting with the fiber direction of the veneers 902B) can favorably be reduced by the relatively high tensile strength in the fiber direction of the veneers 902A in frictional contact (static friction) with the veneers 902B.

Accordingly, even when the veneers 902A and 902B are made thicker (e.g., 6.0 mm or more) than the conventional veneers (2.0 mm to 4.0 mm), cracking of the veneers 902A and 902B that is attributed to elongational deformation of the veneers 902A and 902B in the directions in which the lathe checks 903A and 903B expand, can favorably be reduced. Specifically, further development of the lathe checks 903A and 903B which expand proportionally to the increase in the thicknesses of the veneers 902A and 902B can favorably be reduced. This modification may be consistent with the recent technological trends of increasing the thicknesses of veneers as one of the purposes of reducing the amounts of adhesives used in manufacturing plywood boards.

The present embodiment illustrates an example of the modes for carrying out the invention. Thus, the invention is not limited to the configuration of the present embodiment. The correspondence relationship between the respective components of the present embodiment and the respective components of the invention are described below.

REFERENCE SIGNS LIST

1 Veneer dehydration system (veneer dehydration system)
2 Veneer (veneer)
2' Layered body (layered body)
2A Veneer (veneer)
2B Veneer (veneer)
2*a* Narrow veneer
2*b* Narrow veneer
2*c* Narrow veneer
4 Veneer stacking device (veneer stacking device)
6 Conveying device
8 Compression device (veneer compression device)
10 Loading device
12 Unloading device

20 Layered-up veneer board (layered-up veneer board)
62 Upper conveying line (first conveying device)
64 Lower conveying line (second conveying device)
64*a* Belt
66 Inclined conveying portion
68 Needle belt conveyor
68*a* Belt
68*b* Veneer dropping device
70 Controller
82 Lower platen (first platen)
82*a* In-paten conveyor
84 Vertical machine frame
85 Horizontal machine frame
86 Activation mechanism
87 Coupling member
88 Upper platen (second platen)
102 Veneer (veneer)
102' Layered body (layered body)
2A Veneer (veneer)
2B Veneer (veneer)
106 Conveying device
120 Layered-up veneer board (layered-up veneer board)
162 Upper conveying line (first conveying device)
162*a* Belt
164 Lower conveying line (second conveying device)
164*a* Belt
166 Reversing mechanism
202A Veneer (veneer)
202B veneer (veneer)
202' Layered body
220 Layered-up veneer board (layered-up veneer board)
302A Veneer (veneer)
302B Veneer (veneer)
302' Layered body
320 Layered-up veneer board (layered-up veneer board)
402A Veneer (veneer)
402B Veneer (veneer)
402' Layered body
420 Layered-up veneer board (layered-up veneer board)
502A Veneer (veneer)
502B Veneer (veneer)
502' Layered body
520 Layered-up veneer board (layered-up veneer board)
602A Veneer (veneer)
602B Veneer (veneer)
602' Layered body
620 Layered-up veneer board (layered-up veneer board)
702 Veneer (veneer)
702*a* Veneer (veneer)
702*b* Veneer (veneer)
720 Layered-up veneer board (layered-up veneer board)
802A Standard-size veneer (veneer)
802Aa Narrow veneer
802Ab Narrow veneer
802Ac Narrow veneer
802B Standard-size veneer (veneer)
802Ba Narrow veneer
802Bb Narrow veneer
802Bc Narrow veneer
820 Layered-up veneer board
902A Veneer (veneer)
902B Veneer (veneer)
903A Lathe checks (fiber direction)
903B Lathe checks (fiber direction)
920 Layered-up veneer board (layered-up veneer board)
JM Joining material

What is claimed is:

1. A veneer dehydration method for removing moisture contained in veneers, comprising the steps of:

(a) forming a layered-up veneer board by layering a second veneer, which is positioned with a fiber direction thereof aligned with a second direction intersecting with a first direction, on a first veneer positioned with a fiber direction thereof aligned with the first direction such that the first veneer and the second veneer are in frictional contact with each other; and (b) removing moisture contained in the first and second veneers by applying pressure to and compressing the layered-up veneer board from above and below in a layering direction.

2. The veneer dehydration method according to claim 1, wherein the step (a) forms the layered-up veneer board by alternately layering the first veneer and the second veneer.

3. The veneer dehydration method according to claim 1, wherein the step (a) forms a layered body by layering a pair of the second veneers on the first veneer, and the layered-up veneer board is formed by layering a plurality of the layered bodies.

4. The veneer dehydration method according to claim 1, wherein the step (a) forms a layered body by layering a pair of the second veneers on a pair of the first veneers, and the layered-up veneer board is formed by layering a plurality of the layered bodies.

5. The veneer dehydration method according to claim 1, wherein the step (a) forms a layered body by layering a set of three of the second veneers on the first veneer, and the layered-up veneer board is formed by layering a plurality of the layered bodies.

6. The veneer dehydration method according to claim 1, wherein the step (a) forms a layered body by layering a set of three of the second veneers on a pair of the first veneers, and the layered-up veneer board is formed by layering a plurality of the layered bodies.

7. The veneer dehydration method according to claim 1, wherein the step (a) forms a layered body by layering a set of three of the second veneers on a set of three of the first veneers, and the layered-up veneer board is formed by layering a plurality of the layered bodies.

8. The veneer dehydration method according to claim 1, wherein the step (a) includes reversing the first veneer to position the second veneer such that the fiber direction thereof extends along the second direction.

9. The veneer dehydration method according to claim 1, wherein the first and second veneers each include a square veneer which has a square shape when viewed from one side in a direction along the layering direction.

10. The veneer dehydration method according to claim 1, wherein the first and second veneers each include a rectangular veneer which has a rectangular shape when viewed from one side in a direction along the layering direction.

11. The veneer dehydration method according to claim 10, wherein the rectangular veneer is formed to have a long side approximately twice as long as a short side.

12. A veneer dehydration system for removing moisture contained in veneers, comprising:

a veneer stacking device capable of stacking the veneers, layered in frictional contact with each other;

a first conveyor configured to convey the veneers to the veneer stacking device with a fiber direction of the veneers aligned with a first direction;

a second conveyor configured to convey the veneers to the veneer stacking device with the fiber direction of the veneers aligned with a second direction intersecting with the first direction;

a veneer compressing device having first and second platens disposed on either side of a direction in which the veneers are layered, the veneer compressing device configured to remove moisture from the veneers by only applying pressure to and compressing the veneers from above and below in the layering direction; and a loader configured to load, between the first and second platens, a layered-up veneer board stacked on the veneer stacking device.

13. The veneer dehydration method according to claim 1, wherein, in the step (b), the layered-up veneer board is compressed by pressure from above and below in the layering direction, and the compression itself dehydrates the first and second veneers.

* * * * *